US009238900B2

(12) United States Patent
Matsumoto et al.

(10) Patent No.: US 9,238,900 B2
(45) Date of Patent: Jan. 19, 2016

(54) FRONT LOADER

(71) Applicant: KUBOTA CORPORATION, Osaka (JP)

(72) Inventors: Atsushi Matsumoto, Osaka (JP); Ryuichi Nadaoka, Osaka (JP); Kosuke Oyama, Osaka (JP); Masahiro Sugioka, Osaka (JP)

(73) Assignee: KUBOTA CORPORATION, Osaka (JP)

( * ) Notice: Subject to any disclaimer, the term of this patent is extended or adjusted under 35 U.S.C. 154(b) by 0 days.

(21) Appl. No.: 14/662,493

(22) Filed: Mar. 19, 2015

(65) Prior Publication Data

US 2015/0275471 A1 Oct. 1, 2015

(30) Foreign Application Priority Data

| | | |
|---|---|---|
| Mar. 27, 2014 | (JP) | 2014-067009 |
| Mar. 31, 2014 | (JP) | 2014-072106 |
| Mar. 31, 2014 | (JP) | 2014-072107 |
| Mar. 31, 2014 | (JP) | 2014-072108 |

(51) Int. Cl.
*E02F 3/43* (2006.01)
*E02F 9/20* (2006.01)
(Continued)

(52) U.S. Cl.
CPC ..... *E02F 3/432* (2013.01); *E02F 3/3417* (2013.01); *E02F 3/431* (2013.01); *E02F 3/433* (2013.01); *E02F 9/2037* (2013.01); *E02F 9/24* (2013.01)

(58) Field of Classification Search
CPC ..... E02F 3/432; E02F 3/3417; E02F 3/433; E02F 3/431; E02F 9/24; E02F 9/2037
See application file for complete search history.

(56) References Cited

U.S. PATENT DOCUMENTS

2007/0168100 A1* 7/2007 Danko ..... B25J 9/1628 701/50
2011/0150614 A1 6/2011 Nicholson et al.
(Continued)

FOREIGN PATENT DOCUMENTS

| | | |
|---|---|---|
| EP | 1903147 | 3/2008 |
| GB | 2272204 | 5/1994 |
| JP | 2009-52287 | 3/2009 |

OTHER PUBLICATIONS

U.S. Appl. No. 14/659,991 to Atsushi Matsumoto et al., filed Mar. 17, 2015.
(Continued)

*Primary Examiner* — James Trammell
*Assistant Examiner* — James E Stroud
(74) *Attorney, Agent, or Firm* — Greenblum & Bernstein, P.L.C.

(57) ABSTRACT

The front loader includes a boom actuator configured to pivotally drive a boom along a vertical direction relative to a traveling vehicle body about a first pivot axis which is oriented along a right/left direction, a bucket actuator configured to pivotally drive a bucket along the vertical direction relative to the boom about a second pivot axis which is oriented along the right/left direction, a manual controlling section for controlling operations of the boom actuator and the bucket actuator based on a manual operation of an operational tool, a boom angle detector for detecting a vertical pivot angle of the boom, a bucket angle detector for detecting a vertical pivot angle of the bucket relative to the boom, a calculating section for calculating a ground pivot angle of the bucket based on an output from the boom angle detector and an output from the bucket angle detector.

3 Claims, 14 Drawing Sheets

(51) Int. Cl.
*E02F 9/24* (2006.01)
*E02F 3/34* (2006.01)

(56) References Cited

U.S. PATENT DOCUMENTS

2013/0259622 A1* 10/2013 Shirao ..... E02F 9/22 414/685
2014/0244101 A1* 8/2014 Chitty ..... E02F 9/2054 701/31.6
2015/0147147 A1* 5/2015 Uchiyama ..... E02F 3/32 414/687
2015/0275470 A1* 10/2015 Matsumoto ..... E02F 3/3417 701/50

OTHER PUBLICATIONS

European Search Report in counterpart European Application No. 15160095.4, dated Sep. 18, 2015.

* cited by examiner

FRONT LOADER

TECHNICAL FIELD

The present invention relates to a front loader including a boom actuator configured to pivotally drive a boom along a vertical direction relative to a traveling vehicle body about a first pivot axis which is oriented along a right/left direction, and a bucket actuator configured to pivotally drive a bucket along the vertical direction relative to the boom about a second pivot axis which is oriented along the right/left direction.

BACKGROUND ART

According to a known front loader of the above-described type, the front loader is equipped with a tilt angle detecting means for detecting a tilt angle of the bucket so that a scooping action of the bucket may be stopped when the tilt angle detected by the tilt angle detecting means enters a dropping range in which a scooped object can drop off the bucket and also with an automatic dumping control valve configured to cause the bucket to effect a dumping action in operative association with an upward movement of the boom (see Patent Document 1 for instance).

Further, there is also known a front loader configured such that a posture of the bucket (an implement) is maintained constant, irrespective of any pivotal displacement of the boom, by means of an extension/contraction operation of a mechanical type parallel guide mechanism (see Patent Document 2 for instance).

SUMMARY OF THE INVENTION

In the case of the arrangement disclosed in Japanese Unexamined Patent Application Publication No. 2009-52287, even when it is desired to largely pivot the bucket when the boom is located at a relatively low level position in the course of its rising movement, a scooping action of the bucket will be stopped in association with entry of the tilt angle of the bucket to the dropping range. Thus, there remains room for improvement.

Further, in the case of the arrangement disclosed in European Patent Application Publication No. 1903147, as the posture of the bucket is maintained constant irrespective of any pivotal displacement of the boom, the more upwardly pivoted the boom, the greater the relative angle formed between the boom and the bucket, or conversely, the more downwardly pivoted the boom, the smaller the relative angle formed between the boom and the bucket. For this reason, after the bucket is largely pivoted for scooping action, subsequent to an upward pivotal operation of the boom, if the bucket is pivoted downwards directly, i.e. in direct succession thereto, accidental contact can occur between the boom and the bucket due to the relative angle which becomes smaller due to the posture of the bucket being maintained constant, thus the downward pivotal operation of the boom may be disabled. Thus, there remains room for improvement.

In view of the above-described problems, there still exists a need for a front loader having improved operability that allows a large scooping pivotal action of the bucket when this bucket is located at a relatively low level position and that also allows smooth downward pivotal action of the boom without inviting accidental contact between the boom and the bucket even when the boom is pivoted downwards after the bucket is largely pivoted for a scooping action.

According to the present invention, a front loader comprises:

a boom actuator configured to pivotally drive a boom along a vertical direction relative to a traveling vehicle body about a first pivot axis which is oriented along a right/left direction;

a bucket actuator configured to pivotally drive a bucket along the vertical direction relative to the boom about a second pivot axis which is oriented along the right/left direction;

a manual controlling section for controlling operations of the boom actuator and the bucket actuator based on a manual operation of an operational tool;

a boom angle detector for detecting a vertical pivot angle of the boom;

a bucket angle detector for detecting a vertical pivot angle of the bucket relative to the boom;

a calculating section for calculating a ground pivot angle (i.e. pivot angle relative to the ground surface) of the bucket based on an output from the boom angle detector and an output from the bucket angle detector;

a storage section storing relation data representing relation between a vertical pivot angle of the boom and a limit scoop angle of the bucket;

a setting section for setting the limit scoop angle corresponding to a vertical pivot angle of the boom, based on the output from the boom angle detector and the relation data; and a scoop angle limit controlling section configured to control an operation of the bucket actuator in such a manner that the ground pivot angle of the bucket will not exceed the set limit scoop angle when arrival of the ground pivot angle of the bucket at the set limit scoop angle is detected based on an output from the setting section and an output from the calculating section.

With the above-described configuration, for instance, if the relation data may set, for a large vertical pivot angle of the boom, the limit scoop angle to a constant angle capable of preventing drop of a scooped object from the bucket to the boom side and may set, for a small vertical pivot angle of the boom, the limit scoop angle to an angle greater than the drop preventing angle as long as this angle allows prevention of accidental contact of the bucket with the boom. With the above setting, through control operation of the scoop angle limit controlling section based on an output from the setting section and an output from the calculating section, when the bucket is located at a relatively low position, it is possible to pivot this bucket largely even if the boom is currently in the course of its upward movement. Consequently, it becomes possible to effect in a favorable manner a scooping operation of a scooping object e.g. earth or sand which is present at a position higher than the ground surface.

And, after completion of the above scooping operation, when the boom is further pivoted upwards for conveying the scooped object, the ground pivot angle of the bucket is limited to the limit scoop angle for drop prevention, so that it is possible to avoid occurrence of inconvenient dropping of the scooped object from the bucket to the boom side during the conveying.

Moreover, after completion of the scooping operation, when the boom is pivoted downwards with the bucket being largely pivoted for scooping, in association with approaching of the bucket to the boom with this downward pivotal movement of the latter, the bucket actuator will be actuated under the control operation of the scoop angle limit controlling section, the above downward pivotal movement of the boom is allowed to proceed with automatic avoidance of e.g. accidental contact between the boom and the bucket.

Therefore, when the bucket is located at a relatively low position, this bucket can be pivoted largely for scooping and also dropping of scooped object during conveyance from the bucket to the boom can be prevented. Moreover, even when the boom is downwardly pivoted with the bucket being largely pivoted, this downward pivot movement of the boom is allowed to proceed smoothly without inviting e.g. accidental contact between the boom and the bucket. In this way, there has been realized the intended front loader having improved operability.

In the above configuration, preferably, in the relation data, if the vertical pivot angle of the boom is greater than the set angle, the limit scoop angle of the bucket is limited to be smaller than a first predetermined angle capable of preventing dropping of a scooped object from the bucket to the boom side. With this configuration, it is possible to prevent dropping of a scooped object due to the vertical pivot angle of the bucket becoming too large. Further, preferably, in the relation data, if the vertical pivot angle of the bucket is smaller than the set angle, the limit scoop angle of the bucket to limited to be smaller than a second predetermined angle which is greater than the first predetermined angle. With this configuration, when the height position of the bucket is relatively low, the bucket can be pivoted largely for scooping even if the boom is currently in the course of its elevation. As a result, a scooping operation can be carried out favorably on a scooping target such as earth/sand which is present at a position higher than the ground surface. Further, preferably, the second predetermined angle is set to an angle at which the bucket does not come into contact with the boom. With this configuration, inadvertent contact between the boom and the bucket can be avoided.

According to one preferred solution provided by the present invention, the front loader further comprises:

a ground angle maintaining controlling section for controlling the operation of the bucket actuator such that a ground pivot angle of the bucket may be maintained constant irrespective of any vertical pivotal movement of the boom;

wherein the manual controlling section controls the operation of the bucket actuator on priority over the ground angle maintaining controlling section; and the scoop angle limit controlling section controls the operation of the bucket actuator on priority over the ground angle maintaining controlling section and the manual controlling section.

With the above-described solution, with the control operation by the ground angle maintaining controlling section, the ground pivot angle of the bucket can be maintained constant, irrespective of any vertical pivotal movement of the boom. Thus, the prevention of dropping of scooped object from the bucket can be realized in an even more favorable manner.

And, while the ground pivot angle of the bucket is being maintained constant with the control operation by the ground angle maintaining controlling section, if there arises a need to pivot the bucket for a scooping operation or a dumping operation, the bucket can be readily pivoted for the scooping or dumping operation by a manual operation on the operational tool.

And, under both the condition of the ground pivot angle being maintained constant irrespective of vertical pivotal movement of the boom and the condition of the bucket being pivoted for scooping or dumping by a manual operation on the operational tool, prevention of dropping of scooped object from the bucket and inadvertent contact between the boom and the bucket can be realized in a favorable manner, thanks to the control operation by the scoop angle limit controlling section based on an output from the setting section and an output from the calculating section.

Therefore, it is possible to provide a front loader with further improved operability that allows maintaining the ground pivot angle of the bucket constant, yet allowing also a pivotal operation of the bucket on priority over this maintenance, allowing also effective prevention of dropping of scooped object form the bucket and accidental contact between the boom and the bucket.

In the above configuration, preferably, the storage section stores information relating to target ground pivot angles for ground angle maintaining control. With this configuration, the ground angle maintaining controlling section can execute the ground angle maintaining control in a reliable manner based on the information stored in the storage section.

In the above configuration, preferably, a ground pivot angle outputted from the calculating section when a predetermined operational tool is operated by a rider's operation on this operational tool is stored as the target ground pivot angle in the storage section. With this configuration, a target ground pivot angle can be set by a simple operation.

In the above configuration, preferably, the ground angle maintaining controlling section executes the control such that the ground pivot angle may be confined within a non-sensitive range which is a predetermined range from the target ground pivot angle. With this configuration, it becomes possible to reduce the control frequency, thereby smoothing the bucket movement.

According to a further preferred solution provided by the present invention, the relation data is set such that the closer the vertical pivot angle of the boom to the set angle, the greater the limit scoop angle of the bucket, in case the vertical pivot angle of the boom is smaller than the set angle, whereas the limit scoop angle of the bucket is maintained at a constant angle allowing prevention of dropping of scooped object from the bucket to the boom side in case the vertical pivot angle of the boom exceeds the set angle.

This relation data is set in consideration of the observations that in case the boom is vertically pivoted with the ground pivot angle of the bucket being maintained constant, the relative angle between the boom and the bucket becomes larger as the boom is pivoted more upwards, thus making it difficult for the bucket to contact the boom or the like; whereas, conversely, the relative angle between the boom and the bucket becomes smaller as the boom is pivoted more downwards, thus making it easy for the bucket to contact the boom or the like and also that in case the boom is vertically pivoted with the relative angle between the boom and the bucket being maintained constant, the ground pivot angle of the bucket becomes larger as the boom is pivoted more upwards; whereas, conversely, the ground pivot angle of the bucket becomes smaller as the boom is pivoted more downwards.

With the above-described solution, when the bucket is located at a relatively low position, this bucket can be pivoted largely for scooping and also dropping of scooped object during conveyance from the bucket to the boom can be prevented. Moreover, even when the boom is downwardly pivoted with the bucket being largely pivoted, this downward pivot movement of the boom is allowed to proceed smoothly without inviting e.g. accidental contact between the boom and the bucket.

MODES OF EMBODYING THE INVENTION

First Embodiment

Next, as an exemplary implementation of the present invention, a front loader relating to the present invention will be described with reference to the accompanying drawings by way of a first embodiment wherein the front loader is mounted to a tractor as an example of a traveling vehicle body.

Figure 1:
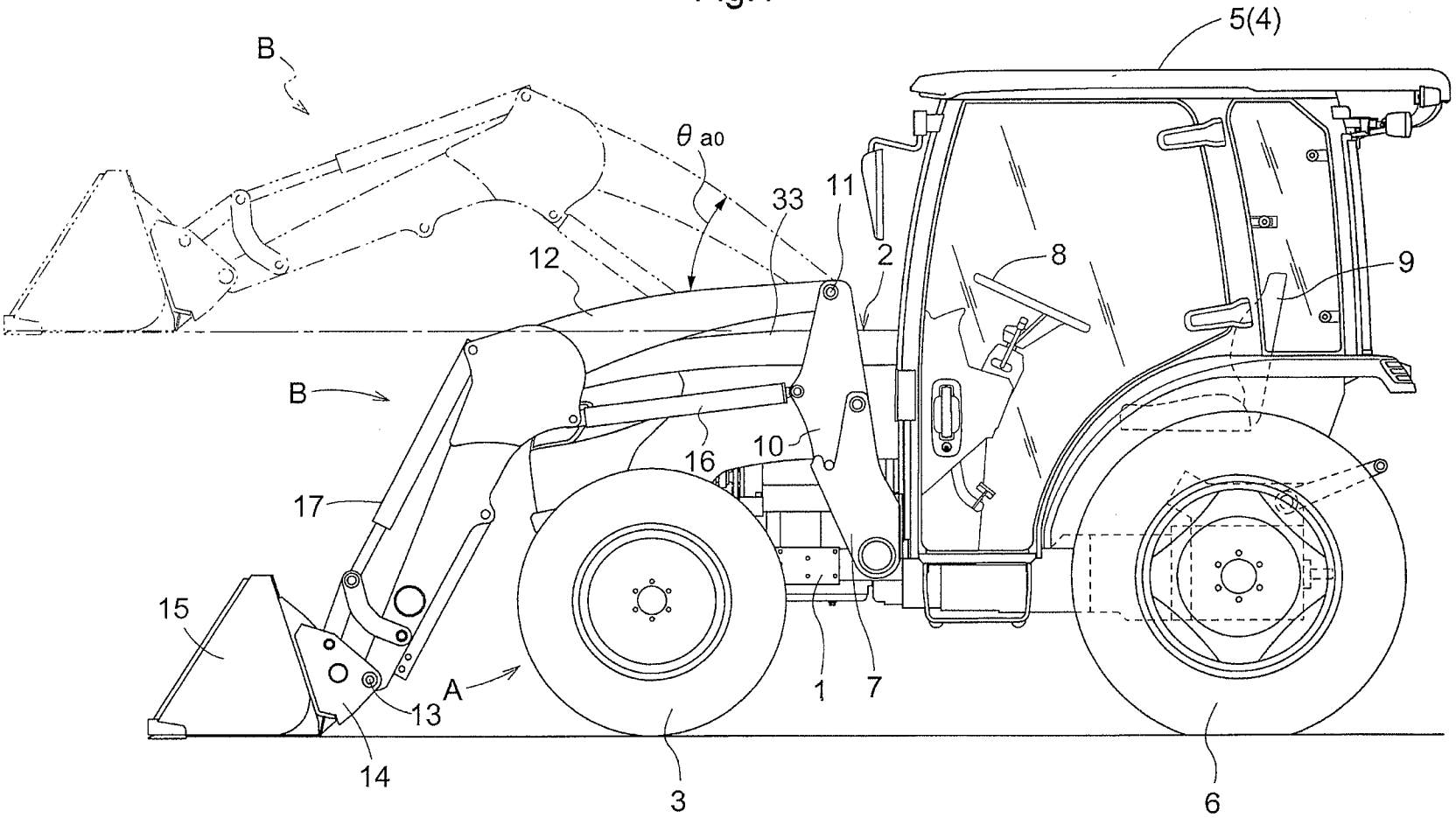
FIG. 1 is a left side view of a tractor mounting a front loader according to a first embodiment.

As shown in FIG. 1, a tractor A as an example of a traveling vehicle body in the first embodiment includes, on the front side of a vehicle body frame 1, an engine section 2 and right and left front wheels 3, etc. The tractor A also includes, on the rear side of the vehicle body frame 1, a cabin 5 forming a riding driver's section 4 and right and left rear wheels 8, etc. At a front/rear intermediate portion of the vehicle body frame 1, there are mounted right and left support brackets 7 allowing mounting of a front loader B. The riding driver's section 4 includes a steering wheel 8, a driver's seat 9, etc.

Figure 2:
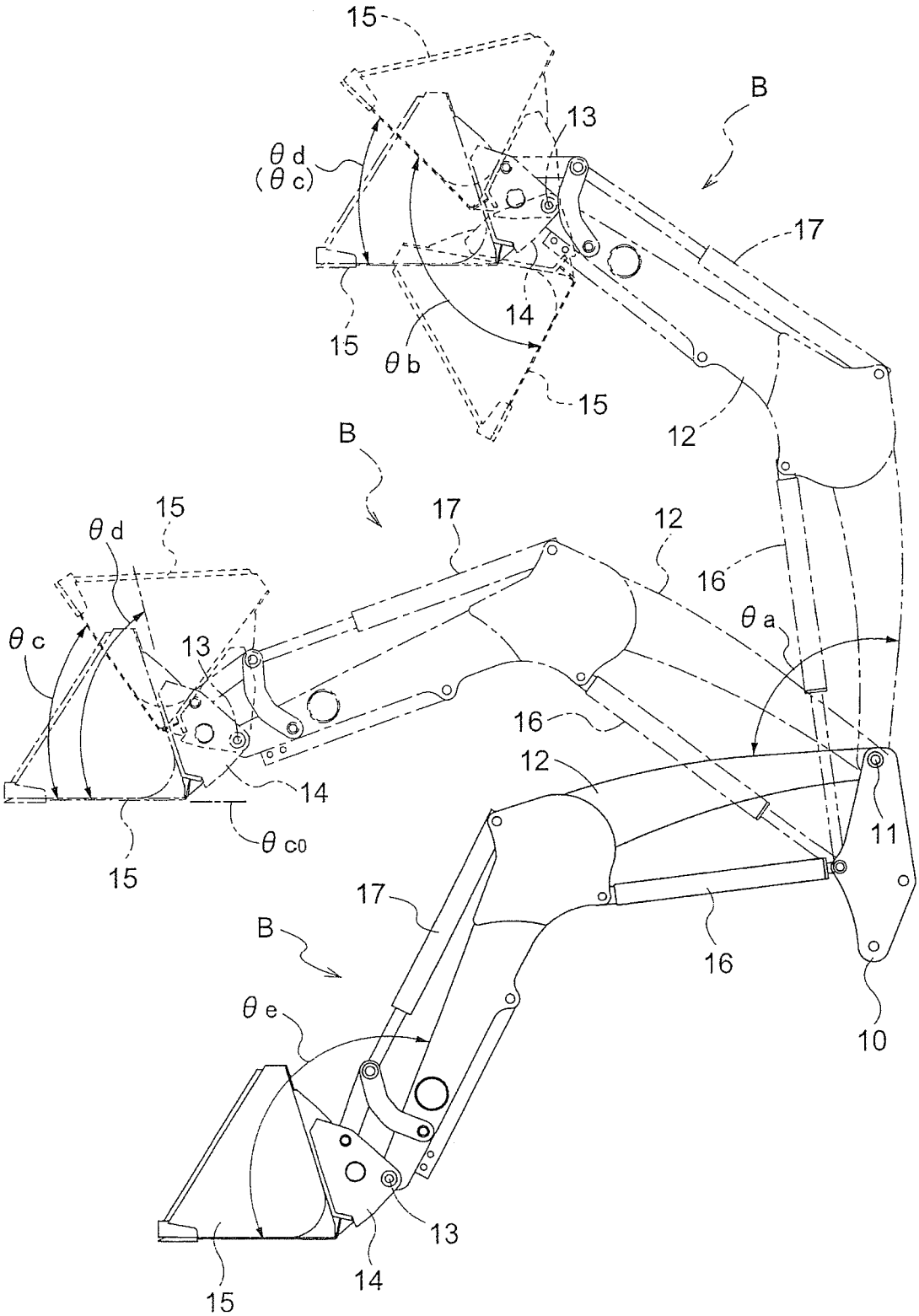
FIG. 2 is a left side view showing an operative condition of the front loader according to the first embodiment.
Figure 3:
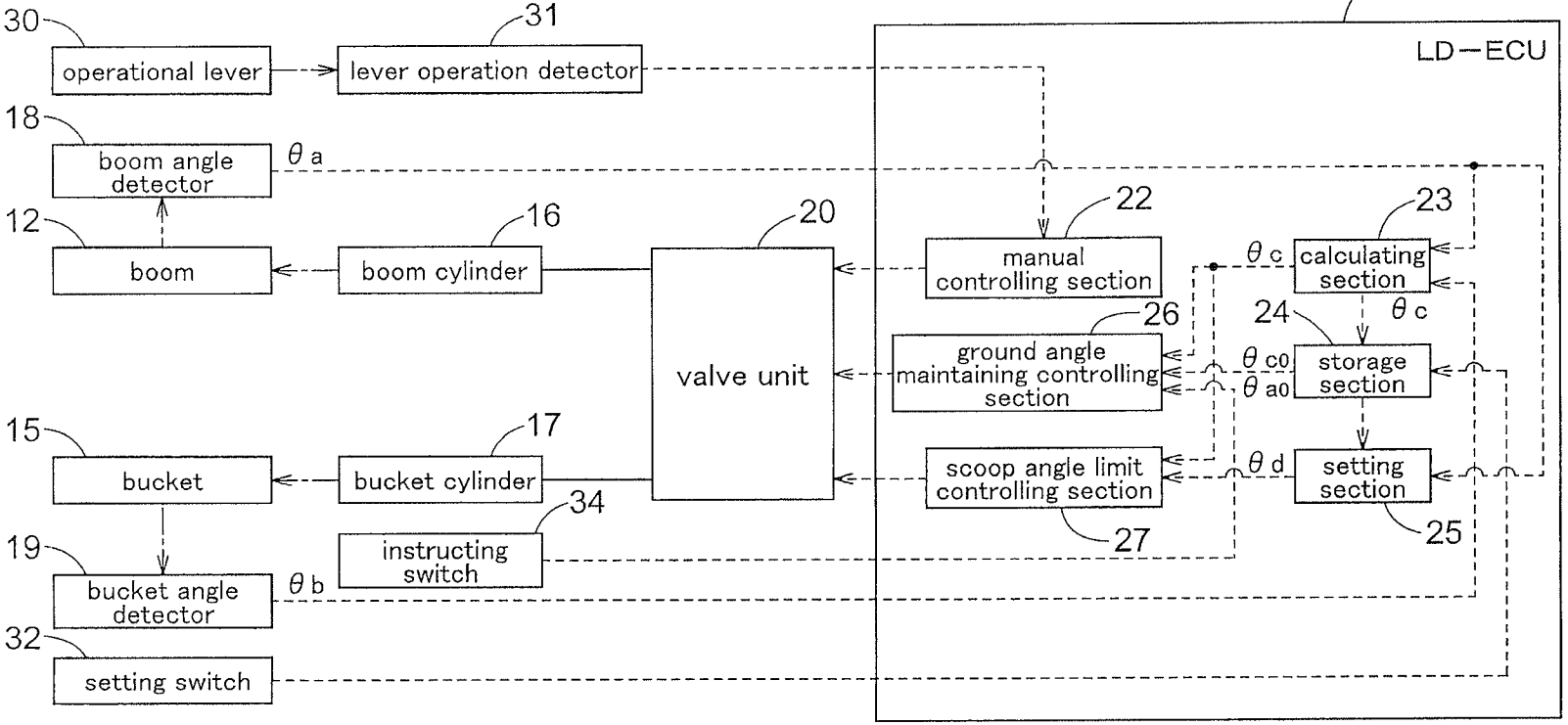
FIG. 3 is a block diagram showing a controlling configuration relating to the front loader according to the first embodiment.

As shown in FIGS. 1 through 3, the front loader B includes right and left fixed brackets 10 detachably mounted on corresponding support brackets 7, right and left booms 12 vertically pivotally connected to the corresponding fixed brackets 10 via a first support shaft 11 which is oriented in the right/left direction, right and left pivot brackets 14 vertically pivotally connected to free ends of the corresponding booms 12 via a second support shaft 13 which is oriented in the right/left direction, a bucket 15 detachably attached to the right and left pivot brackets 4, hydraulic double-action type right and left boom cylinders 16 used as "boom actuators", hydraulic double-action type right and left bucket cylinders 17 used as "bucket actuators", a boom angle detector 18 for detecting a vertical pivot angle (θa) of one of the right and left booms 12, a bucket angle detector 19 for detecting a vertical pivot angle (θb) of the bucket 15 relative to the right and left booms 12, and so on.

The right and left boom cylinders 16 pivotally drive the corresponding booms 12 in the vertical direction about the first support shaft 11 relative to the tractor A. The right and left bucket cylinders 17 pivotally drive the bucket 15 together with the right and left pivot brackets 14 in the vertical direction about the second support shaft 13 relative to the respective booms 12. The boom angle detector 18 and the bucket angle detector 19 comprise rotary type potentiometers in this implementation.

As shown in FIG. 3, the tractor A includes a valve unit 20 for controlling flow of oil to the right and left boom cylinders 16 and the right and left bucket cylinders 17 and an electronic control unit ("LD-ECU" hereinafter) 21 for the front loader configured to control operations of the right and left boom cylinders 16 and the right and left bucket cylinders 17 via the valve control unit 20.

Though not shown, the hydraulic control unit (valve unit) 20 includes an electronic control valve for the boom configured to control flow of oil fed to the right and left boom cylinders 16, an electronic control valve for the bucket configured to control flow of oil fed to the right and left bucket cylinders 17, etc.

As shown in FIG. 2 and FIG. 3, the LD-ECU 21 comprises a microcomputer having such components as a CPU, an EEPROM, etc. And, this LD-ECU 21 includes a manual controlling section 22 enabling manual operations of the right and left booms 12 and the bucket 15, a calculating section 23 for effecting various calculations, a storage section 24 for storing various kinds of data, a setting section 25 for setting a limit scoop angle of the bucket, a ground angle maintaining controlling section 26 for effecting ground angle maintaining control for maintaining a ground pivot angle (θc) of the bucket 15 constant, a scoop angle limit controlling section 27 for effecting scoop angle limiting control for limiting the ground pivot angle (θc) of the bucket 15 in its scooping direction, and so on.

The manual controlling section 22 controls operations of the right and left boom cylinders 16 and the right and left bucket cylinders 17 in response to manual operations on an operational lever 30 provided in the riding driver's section 4 as an operational tool for operating the front loader. This operational lever 30 comprises a cross-pivoting, neutral-return type lever. More particularly, the manual controlling section 22 effects manual operation control for controlling the right and left boom cylinders 16 and the right and left bucket cylinders 17 based on an output from a lever operation detector 31 configured to detect an operated position of the operational lever 30.

In the manual operation control, an operated position of the operational lever 30 is determined based on an output from the lever operation detector 31. And, if this operated position of the operational lever 30 is determined as an UP position, during continuation of this operation to the UP position, the right and left boom cylinders 16 are extended to pivot the right and left booms 12 upwards. Whereas, if the operated position of the operational lever 30 is determined as a DOWN position, during continuation of this operation to the DOWN position, the right and left boom cylinders 16 are contracted to pivot the right and left booms 12 downwards. Further, if the operated position of the operational lever 30 is determined as a SCOOP position, during continuation of this operation to the SCOOP position, the right and left bucket cylinders 17 are contracted to pivot the bucket 15 upwards (scooping pivot movement). Whereas, if the operated position of the operational lever 30 is determined as a DUMP position, during continuation of this operation to the DUMP position, the right and left bucket cylinders 17 are extended to pivot the bucket 15 downwards (dumping pivot movement). Moreover, the operated position of the operational lever 30 is determined as a NEUTRAL position, while the lever is kept at this NEUTRAL position, extending operations of the right and left boom cylinders 16 and the right and left bucket cylinders 17 are stopped in order to stop any vertical pivotal movements of the right and left booms 12 and the bucket 15.

The lever operation detector 31 can employ e.g. a plurality of switches for detecting the pivotal operations of the operational lever 30 to the various operated positions, or a rotary potentiometer for detecting a pivotal operation of the operational lever 30 in the front/rear direction in combination with a further rotary potentiometer for detecting a pivotal operation of the operational lever 30 in the right/left direction.

The calculating section 23 calculates a ground pivot angle (θc) of the bucket 15 based on an output from the boom angle detector 18 and an output from the bucket angle detector 19 and then outputs this calculation result to the storage section 24, the ground angle maintaining controlling section 26, and the scoop angle limit controlling section 27, etc.

The storage section 24 stores the ground pivot angle (θc) of the bucket 15 outputted from the calculating section 23 as a control target angle (θco) if a setting switch 32 for setting control target angle provided in the riding driver's section 4 was depressed. More particularly, if the operational lever 30 was operated to actuate the right and left boom cylinders 16 and the right and left bucket cylinders 17 to operate the bucket 15 to a desired ground pivot angle (θc) and then the setting switch 32 was depressed, this ground pivot angle (θc) of the bucket 15 can be stored as the control target angle (θco) for ground angle maintaining control in the storage section 24. Meanwhile, FIG. 2 illustrates a condition wherein the control target angle (θco) for ground angle maintaining control is set to an angle for placing the bottom face of the bucket 15 horizontal.

Further, there are also stored map data for scoop angle limit control, which comprise relation data representing relations between vertical pivot angles (θa) of the right and left booms 12 and the limit scoop angles (θd) of the bucket 15. The map data are set as follows. Namely, if the vertical pivot angle (θa) of the right and left booms 12 is smaller than the set angle (θco), it is determined that the bucket 15 is currently located at a downward scooping area. Then, in order to avoid accidental contact between the bucket 15 and the right and left booms 12 or the right and left boom cylinders 16 resulting from a scooping operation of this bucket 15, the limit scoop angle (θd) is progressively increased as the vertical pivot angle (θa) of the right and left booms 12 approaches the set angle (θao) (e.g. the limit scoop angle (θd) may be set to 55 degrees when the vertical pivot angle (θa) of the right and left booms 12 is equal to the set angle (θao)). Further, if the vertical pivot angle (θa) of the right and left booms 12 exceeds the set angle (θco), it is determined that the bucket 15 is currently located at an upward conveying/dumping area. Then, the limit scoop angle (θd) of the bucket 15 is set to a constant (fixed) angle (e.g. 45 degrees) for preventing dropping of a scooped object such as an amount of earth/sand from the bucket 15 to the boom side, irrespective of the vertical pivot angle (θa) of the right and left booms 12.

The following considerations underlie the above-described setting arrangement. In case the right and left booms 12 are vertically pivoted with the ground pivot angle (θc) of the bucket 15 being maintained constant, the relative angle (θe) between the booms 12 and the bucket 15 becomes larger as the right and left booms 12 are pivoted more upwards, thus making it difficult for the bucket 15 to contact the booms 12 or the like. Conversely, the relative angle (θe) between the right and left booms 12 and the bucket 15 becomes smaller as the right and left booms 12 are pivoted more downwards, thus making it easy for the bucket 15 to contact the booms 12 or the like. Also, in case the right and left booms 12 are vertically pivoted with the relative angle (θe) between the booms 12 and the bucket 15 being maintained constant, the ground pivot angle (θc) of the bucket 15 becomes larger as the right and left booms 12 are pivoted more upwards; whereas, conversely, the ground pivot angle (θc) of the bucket 15 becomes smaller as the right and left booms 12 are pivoted more downwards. Further, although various modifications are possible for the set angle (θao), in this implementation, this angle is set as an angle at which the bottom portion of the bucket 15 reaches the upper end position of a hood 33 provided in the engine section 2 (see FIG. 1).

The setting section 25 sets a limit scoop angle (θd) of the bucket 15 in correspondence with the vertical pivot angle (θe) of the right and left booms 12, based on an output from the boom angle detector 18 and the map data for the scoop angle control. Hereinafter, a limit scoop angle (θd) of the bucket 15 set by the setting section 25 will be referred to as a set limit scoop angle (θd).

The ground angle maintaining controlling section 26 effects ground angle maintaining control in case an instruction switch 34 for ground angle maintaining control provided in the riding driver's section 4 is depressed during stop of execution of the ground angle maintaining control. Also, this ground angle maintaining control is terminated if the instruction switch 34 for ground angle maintaining control is depressed during execution of ground angle maintaining control.

In the ground angle maintaining control, based on the control target angle (θco) for ground angle maintaining control stored in the storage section 24 and the ground pivot angle (θc) of the bucket 15 outputted from the calculating section 23, the operation of the right and left bucket cylinders 17 is controlled such that the ground pivot angle (θc) of the bucket 15 may agree to the control target angle (θco) for ground angle maintaining control (be present within a non-sensitive range of the control target angle (θco)), irrespective of any vertical pivotal drive of the right and left booms 12 by the control operation of the manual controlling section 22 based on a manual operation on the operational lever 30.

With the above, it is possible to maintain the ground pivot angle (θc) of the bucket 15 to the control target angle (θco) for ground angle maintaining control (desired ground pivot angle), irrespective of any vertical pivotal drive of the right and left booms 12 by the control operation of the manual controlling section 22 based on a manual operation on the operational lever 30.

The scoop angle limit controlling section 27 controls the operation of the right and left bucket cylinders 17 based on an output from the setting section 25 and an output from the calculating section 23 in such a manner that when it is detected that the ground pivot angle (θc) of the bucket 15 has reached the set limit scoop angle (θd) (i.e. when the ground pivot angle (θc) of the bucket 15 has entered the non-sensitive range of the set limit scoop angle (θd)), the ground pivot angle (θc) of the bucket 15 will not exceed the set limit scoop angle (θd) (i.e. the ground pivot angle (θc) of the bucket 15 will not exceed the non-sensitive range of the set limit scoop angle (θd)).

The priority order of controlling the operation of the right and left bucket cylinders 17 by the manual controlling section 22, the ground angle maintaining controlling section 26 and the scoop angle limit controlling section 27 are set such that the manual controlling section 22 may control the operation of the right and left bucket cylinders 17 on priority over the ground angle maintaining controlling section 26 and also that the scoop angle limit controlling section 27 may control the operation of the right and left bucket cylinders 17 on priority over the manual controlling section 22 and the ground angle maintaining controlling section 26.

With the above-described arrangement, for instance, in case the vertical pivot angle (θa) of the right and left booms 12 is smaller than the set angle (θao), when the right and left bucket cylinders 17 are contracted to pivot the bucket for scooping under the operation control by the manual controlling section 22 based on a manual operation on the operational lever 30 to the SCOOP position, if during this scooping pivot movement of the bucket 15 the bucket 15 approaches the right and left booms 12 whereby the ground pivot angle (θc) of the bucket 15 reaches the limit scoop angle (θd), the scoop angle limit controlling section 27 will stop the right and left lift cylinders 17 on priority over the manual controlling section 22, thus stopping the scooping pivot movement of the bucket 15.

Consequently, even when the bucket 15 is located within a downward scooping range, it is still possible to avoid the inconvenience of the bucket 15 coming into accidental contact with the right and left booms 12 or the right and left boom cylinders 16 in association with a scooping operation of the bucket 15.

Further, in case the vertical pivot angle (θa) of the right and left booms 12 exceeds the set angle (θao), when the right and left boom cylinders 16 are extended to pivot the right and left booms 12 upwards based on a manual operation on the operational lever to the UP position, if during this upward pivot movement the ground pivot angle (θc) of the bucket 15 reaches the limit scoop angle (θd), the scoop angle limit controlling section 27 will act on priority over the manual controlling section 22 even if the operational lever 30 is not operated to the DUMP position, so as to extend the right and left bucket cylinders 17 for causing the bucket 15 to effect a dumping pivot action in such a manner that the ground pivot angle (θc) of the bucket 15 will not exceed the fixed limit scoop angle (θd) for drop prevention, irrespective of the vertical pivot angle (θa) of the right and left booms 12.

As a result, it is possible to prevent inconvenience of dropping of scooped object such as an amount of earth/sand within the bucket to the boom side due to the ground pivot angle (θc) of the bucket 15 exceeding the drop prevention limit scoop angle (θd) in association with an upward movement of the right and left booms 12 when the bucket 15 is located within the upward dumping/conveying range.

Further, under the control operation of the ground angle maintaining controlling section 26, under the condition of the ground pivot angle (θc) of the bucket 15 being maintained at the control target angle (θc) for the ground angle maintaining control, irrespective of any vertical pivotal drive of the right and left booms 12, if the operational lever 30 is operated to the SCOOP position or the DUMP position; then, based on this operation, the manual controlling section 22 will control the operation of the right and left bucket cylinders 17 to cause the bucket 15 to effect a scooping pivot movement or a dumping pivot movement, on priority over the ground angle maintaining controlling section 26.

As a result, when the ground pivot angle (θc) of the bucket 15 is being maintained constant by the control operation by the ground angle maintaining controlling section 26, if the driver desires to scoop some additional amount of earth/sand or the like by slightly additional scooping pivot movement of the bucket 15, this scooping operation of earth/sand or the like can be effected by a scooping pivot movement of the bucket 15 by a manual operation on the operational lever 30, without requiring trouble of depressing the instruction switch 34 for the ground angle maintaining control to end this ground angle maintaining control.

And, even when the ground pivot angle (θc) of the bucket 15 reaches the set scoop limit angle (θd) with this scooping pivot movement of the bucket 15, the scoop angle limit controlling section 27 will function on priority over the manual controlling section 22 to stop the right and left bucket cylinders 17, thus stopping the scooping pivot movement of the bucket 15.

As a result, even when the manual controlling section 22 is controlling the operation of the right and left bucket cylinders 17 on priority over the ground angle maintaining controlling section 26, it is still possible to prevent the inconvenience of the bucket 15 coming into accidental contact with the right and left booms 12 or the right and left boom cylinders 16.

Further, with the control operation by the ground angle maintaining controlling section 26, under the condition of the ground pivot angle (θc) of the bucket 15 being maintained to the control target angle (θco) for the ground angle maintaining control, when the right and left boom cylinders 16 are contracted in response to a control operation of the manual controlling section 22 based on an operation on the operational lever 30 to the DOWN position, to pivot the right and left booms 12 downwards, if during this downward pivot movement the vertical pivot angle (θa) of the right and left booms 12 becomes smaller than the set angle (θao) and the ground pivot angle (θc) of the bucket 15 reaches the set limit scoop angle (θd), the scoop angle limiting controlling section 27 will function on priority over the manual controlling section 22 in association with the downward pivot movement of the right and left booms 12 even if the operational lever 30 is not operated to the DUMP position, so as to cause the right and left bucket cylinders 17 to be extended for causing the bucket 15 to effect a dumping pivot movement in such a manner that the ground pivot angle (θc) of the bucket 15 will not exceed the set limit scoop angle (θd).

With the above-described arrangement, it is possible to avoid the inconvenience of the bucket 15 coming into accidental contact with the right and left booms 12 or the right and left boom cylinders 16 or the like due to a downward movement of the right and left booms 12 under the condition of the ground pivot angle (θc) of the bucket 15 being maintained constant by the control operation of the ground angle maintaining controlling section 26.

Second Embodiment

Next, as an exemplary implementation of the present invention, a front loader relating to the present invention will be described with reference to the accompanying drawings by way of a second embodiment wherein the front loader is mounted to a tractor as an example of a traveling vehicle body.

Incidentally, this second embodiment differs from the above-described first embodiment only in the respects of the features relating to the front loader. Therefore, in the following discussion, only the configuration of the front loader will be explained.

Figure 4:
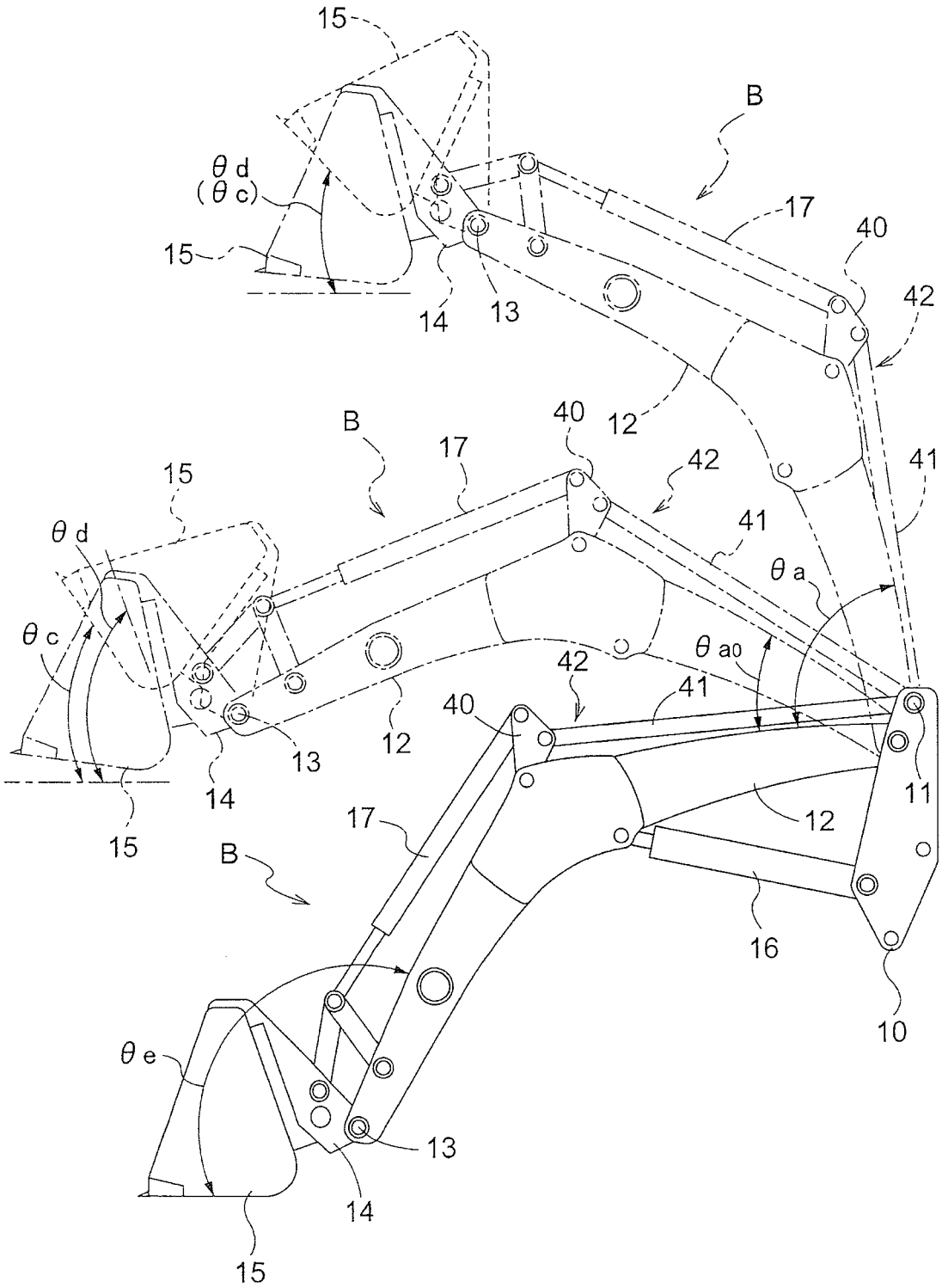
FIG. 4 is a left side view showing an operative condition of a front loader according to a second embodiment.
Figure 5:
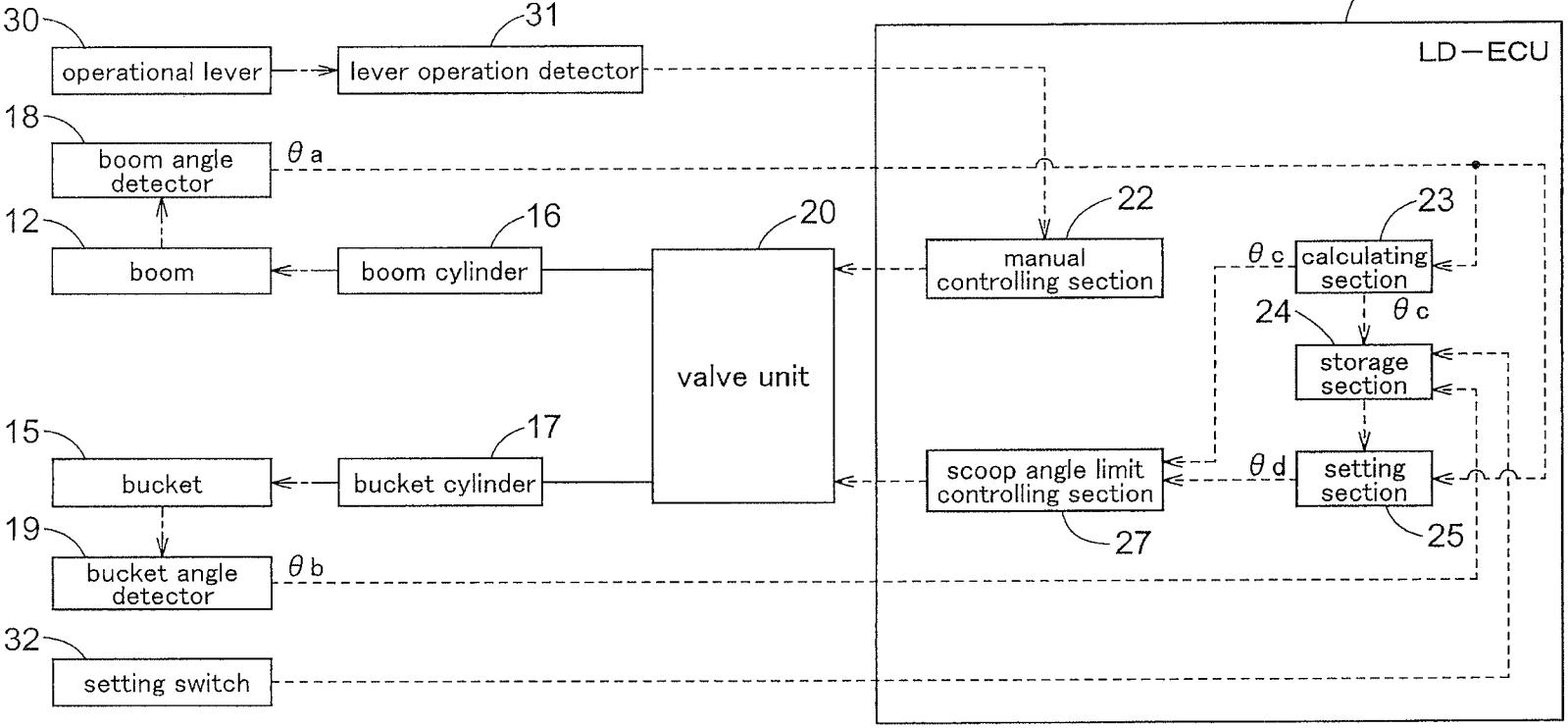
FIG. 5 is a block diagram showing a controlling configuration relating to the front loader according to the second embodiment.

As shown in FIG. 4 and FIG. 5, the front loader B includes right and left fixed brackets 10 detachably mounted on corresponding support brackets 7, right and left booms 12 vertically pivotally connected to the corresponding fixed brackets 10 via a first support shaft 11 which is oriented in the right/left direction, right and left pivot brackets 14 vertically pivotally connected to free ends of the corresponding booms 12 via a second support shaft 13 which is oriented in the right/left direction, a bucket 15 detachably attached to the right and left pivot brackets 4, hydraulic double-action type right and left boom cylinders 16 used as "boom actuators", hydraulic double-action type right and left bucket cylinders 17 used as "bucket actuators", a boom angle detector 18 for detecting a vertical pivot angle (θa) of one of the right and left booms 12, a bucket angle detector 19 for detecting a vertical pivot angle (θb) of the bucket 15 relative to one of the right and left booms 12, and so on.

The right and left bucket cylinders 17 include right and left pivot arms 40 mounted to the right and left booms 12 to be pivotable in the front/rear direction relative thereto, a coupling link 41 extending between the corresponding fixed bracket 10 and the pivot arm 40, and also a mechanical type ground angle maintaining mechanism 42 for maintaining a ground pivot angle (θc) of the bucket 15 approximately to a desired ground pivot angle (θco) corresponding to an extended or contracted length of the right and left bucket cylinders 17, irrespective of any vertical pivot al movement of the right and left booms 12.

As shown in FIG. 5, the tractor A includes a valve unit 20 for controlling flow of oil to the right and left boom cylinders 16 and the right and left bucket cylinders 17 and an electronic control unit ("LD-ECU" hereinafter) 21 for the front loader configured to control operations of the right and left boom cylinders 16 and the right and left bucket cylinders 17 via the valve control unit 20.

Though not shown, the hydraulic control unit (valve unit) 20 includes an electronic control valve for the boom configured to control flow of oil fed to the right and left boom cylinders 16, an electronic control valve for the bucket configured to control flow of oil fed to the right and left bucket cylinders 17, etc.

As shown in FIG. 5, the LD-ECU 21 comprises a microcomputer having such components as a CPU, an EEPROM, etc. And, this LD-ECU 21 includes a manual controlling section 22 enabling manual operations of the right and left booms 12 and the bucket 15, a calculating section 23 for effecting various calculations, a storage section 24 for storing various kinds of data, a setting section 25 for setting a limit scoop angle of the bucket, and a scoop angle limit controlling section 27 for effecting scoop angle limiting control for limiting the ground pivot angle (θc) of the bucket 15 in its scooping direction, and so on.

The manual controlling section 22 controls operations of the right and left boom cylinders 16 and the right and left bucket cylinders 17 in response to manual operations on an operational lever 30 provided in the riding driver's section 4 as an operational tool for operating the front loader. This operational lever 30 comprises a cross-pivoting, neutral-return type lever. More particularly, the manual controlling section 22 effects manual operation control for controlling the right and left boom cylinders 16 and the right and left bucket cylinders 17 based on an output from a lever operation detector 31 configured to detect an operated position of the operational lever 30.

In the manual operation control, an operated position of the operational lever 30 is determined based on an output from the lever operation detector 31. And, if this operated position of the operational lever 30 is determined as an UP position, during continuation of this operation to the UP position, the right and left boom cylinders 16 are extended to pivot the right and left booms 12 upwards. Whereas, if the operated position of the operational lever 30 is determined as a DOWN position, during continuation of this operation to the DOWN position, the right and left boom cylinders 16 are contracted to pivot the right and left booms 12 downwards. Further, if the operated position of the operational lever 30 is determined as a SCOOP position, during continuation of this operation to the SCOOP position, the right and left bucket cylinders 17 are contracted to pivot the bucket 15 upwards (scooping pivot movement). Whereas, if the operated position of the operational lever 30 is determined as a DUMP position, during continuation of this operation to the DUMP position, the right and left bucket cylinders 17 are extended to pivot the bucket 15 downwards (dumping pivot movement). Moreover, the operated position of the operational lever 30 is determined as a NEUTRAL position, while the lever is kept at this NEUTRAL position, extending operations of the right and left boom cylinders 16 and the right and left bucket cylinders 17 are stopped in order to stop any vertical pivotal movements of the right and left booms 12 and the bucket 15.

The lever operation detector 31 can employ e.g. a plurality of switches for detecting the pivotal operations of the operational lever 30 to the various operated positions, or a rotary potentiometer for detecting a pivotal operation of the operational lever 30 in the front/rear direction in combination with a further rotary potentiometer for detecting a pivotal operation of the operational lever 30 in the right/left direction.

The calculating section 23 calculates a ground pivot angle (θc) of the bucket 15 based on an output from the boom angle detector 18 and an output from the bucket angle detector 19 and then outputs this calculation result to the storage section 24, and the scoop angle limit controlling section 27, etc.

The storage section 24 stores map data for scoop angle limit control which comprises relation data representing relation between vertical pivot angles (θa) of the right and left booms 12 and the limit scoop angles (θd) of the bucket 15. The map data are set as follows. Namely, if the vertical pivot angle (θa) of the right and left booms 12 is smaller than the set angle (θco), it is determined that the bucket 15 is currently located at a downward scooping area. Then, in order to avoid accidental contact between the bucket 15 and the right and left booms 12 or the right and left boom cylinders 16 resulting from a scooping operation of this bucket 15, the limit scoop angle (θd) is progressively increased as the vertical pivot angle (θa) of the right and left booms 12 approaches the set angle (θao) (e.g. the limit scoop angle (θd) may be set to 55 degrees when the vertical pivot angle (θa) of the right and left booms 12 is equal to the set angle (θao)). Further, if the vertical pivot angle (θa) of the right and left booms 12 exceeds the set angle (θco), it is determined that the bucket 15 is currently located at an upward conveying/dumping area. Then, the limit scoop angle (θd) of the bucket 15 is set to a constant (fixed) angle (e.g. 45 degrees) for preventing dropping of a scooped object such as an amount of earth from the bucket 15 to the boom side, irrespective of the vertical pivot angle (θa) of the right and left booms 12.

The following considerations underlie the above-described setting arrangement. In case the right and left booms 12 are vertically pivoted with the ground pivot angle (θc) of the bucket 15 being maintained constant, the relative angle (θe) between the booms 12 and the bucket 15 becomes larger as the right and left booms 12 are pivoted more upwards, thus making it difficult for the bucket 15 to contact the booms 12 or the like. Conversely, the relative angle (θe) between the right and left booms 12 and the bucket 15 becomes smaller as the right and left booms 12 are pivoted more downwards, thus making it easy for the bucket 15 to contact the booms 12 or the like. Also, in case the right and left booms 12 are vertically pivoted with the relative angle (θe) between the booms 12 and the bucket 15 being maintained constant, the ground pivot angle (θc) of the bucket 15 becomes larger as the right and left booms 12 are pivoted more upwards; whereas, conversely, the ground pivot angle (θc) of the bucket 15 becomes smaller as the right and left booms 12 are pivoted more downwards. Further, although various modifications are possible for the set angle (θao), in this implementation, this angle is set as an angle at which the bottom portion of the bucket 15 reaches the upper end position of a hood 33 provided in the engine section 2.

The setting section 25 sets a limit scoop angle (θd) of the bucket 15 in correspondence with the vertical pivot angle (θe) of the right and left booms 12, based on an output from the boom angle detector 18 and the map data for the scoop angle control. Hereinafter, a limit scoop angle (θd) of the bucket 15 set by the setting section 25 will be referred to as a set limit scoop angle (θd).

The scoop angle limit controlling section 27 controls the operation of the right and left bucket cylinders 17 based on an output from the setting section 25 and an output from the calculating section 23 in such a manner that when it is detected that the ground pivot angle (θc) of the bucket 15 has reached the set limit scoop angle (θd) (i.e. when the ground pivot angle (θc) of the bucket 15 has entered the non-sensitive range of the set limit scoop angle (θd)), the ground pivot angle (θc) of the bucket 15 will not exceed the set limit scoop angle (θd) (i.e. the ground pivot angle (θc) of the bucket 15 will not exceed the non-sensitive range of the set limit scoop angle (θd)).

The priority order of controlling the operation of the right and left bucket cylinders 17 by the manual controlling section 22 and the scoop angle limit controlling section 27 are set such that the scoop angle limit controlling section 27 may control the operation of the right and left bucket cylinders 17 on priority over the manual controlling section 22.

With the above-described arrangement, for instance, in case the vertical pivot angle (θa) of the right and left booms 12 is smaller than the set angle (θao), when the right and left bucket cylinders 17 are contracted to pivot the bucket for scooping under the operation control by the manual controlling section 22 based on a manual operation on the operational lever 30 to the SCOOP position, if during this scooping pivot movement of the bucket 15 the bucket 15 approaches the right and left booms 12 whereby the ground pivot angle (θc) of the bucket 15 reaches the limit scoop angle (θd), the scoop angle limit controlling section 27 will stop the right and left lift cylinders 17 on priority over the manual controlling section 22, thus stopping the scooping pivot movement of the bucket 15.

Consequently, even when the bucket 15 is located within a downward scooping range, it is still possible to avoid the inconvenience of the bucket 15 coming into accidental contact with the right and left booms 12 or the right and left boom cylinders 16 in association with a scooping operation of the bucket 15.

Further, in case while the right and left booms 12 are being pivoted downwards in association with contraction of the right and left boom cylinders 16 by the control operation of the manual controlling section 22 based on a manual operation on the operational lever 30 to the DOWN position, if the ground pivot angle (θc) of the bucket 15 reaches the limit scoop angle (θd), the scoop angle limit controlling section 27 will act on priority over the manual controlling section 22 even if the operational lever 30 is not operated to the DUMP position, so as to extend the right and left bucket cylinders 17 for causing the bucket 15 to effect a dumping pivot action in such a manner that the ground pivot angle (θc) of the bucket 15 will not exceed the fixed limit scoop angle (θd).

Consequently, even when the bucket 15 is located within a downward scooping range, it is still possible to avoid the inconvenience of the bucket 15 coming into accidental contact with the right and left booms 12 or the right and left boom cylinders 16 in association with a scooping operation of the bucket 15.

Other Embodiments of the First and Second Embodiment

[1] The traveling vehicle body A can be a vehicle dedicated to loader operations, a loader-mower vehicle mounting the front loader B and a mower, a loader-excavator vehicle mounting the front loader B and a backhoe.

[2] The boom actuator 16 and the bucket actuator 17 can be hydraulic motors or the like.

[3] The operational tool 30 can comprise an operational tool for the boom only and a further operational tool for the bucket only. Further, the operational tool 30 can comprise a switch for instructing an upward pivot movement of the boom 12 a switch for instructing a downward pivot movement of the boom 12, a switch for instructing a scooping pivot movement of the bucket 15 and a switch for instructing a dumping pivot movement of the bucket 15.

[4] The boom angle detector 18 can comprise a sliding type potentiometer configured to detect an extended/contracted length of the boom cylinder 16 as a vertical pivot angle (θa) of the boom 12. Further, the bucket angle detector 19 can comprise a sliding type potentiometer configured to detect an extended/contracted length of the bucket cylinder 17 as a vertical pivot angle (θb) of the bucket 15.

[5] The storage section 24 can be configured to store relational expressions as relation data representing relation between the vertical pivot angles (θa) of the boom 12 and the limit scoop angles (θc) of the bucket 15. The setting section 25 can be configured to calculate the limit scoop angles (θc) of the bucket 15 based on such relational expressions and output from the boom angle detector 18.

[6] The relation data representing relation between the vertical pivot angles (θa) of the boom 12 and the limit scoop angles (θc) of the bucket 15 can vary as long as the set data can prevent accidental contact between the bucket 15 and the boom 12 or the like in case the vertical pivot angle (θa) of the boom 12 is smaller than the set angle (θao). For instance, the data can be set such that as the vertical pivot angle (θa) of the boom 12 approaches the set angle (θao), the limit scoop angle (θc) of the bucket 15 is increased in a continuous manner, or as the vertical pivot angle (θa) of the boom 12 approaches the set angle (θao), the limit scoop angle (θc) of the bucket 15 is increased in a stepwise manner. Further, in case the vertical pivot angle (θa) of the boom 12 is smaller than the set angle (θao), the limit scoop angle (θc) of the bucket 15 which varies according to the vertical pivot angle (θa) of the boom 12 can vary in many ways depending on the shapes of the boom 12 and the bucket 15, etc. as long as the possibility of prevention of accidental contact between the bucket 15 and the boom 12 etc. is ensured. For instance, the limit scoop angle (θc) of the bucket 15 can be set to 60 degrees when the vertical pivot angle (θa) of the boom 12 is equal to the set angle (θao).

[7] In the foregoing respective embodiments, the angle of 45 degrees was shown as the angle for drop prevention which is set in case the vertical pivot angle (θa) of the boom 12 exceeds the set angle (θao). However, various settings of this angle are possible depending on e.g. the shape of the bucket 15 as long as such different angles too ensure the possibility of prevention of dropping of scooped object from the bucket 15 to the boom side. For instance, the angle can be 40 degrees or 50 degrees, etc.

[8] As the front loader B, in the first embodiment, there was disclosed a configuration thereof including the ground angle maintaining controlling section 26; and in the second embodiment, there was disclosed a configuration thereof having the ground angle maintaining mechanism 42. However, the invention may be implemented with omission of both the ground angle maintaining controlling section 26 the ground angle maintaining mechanism 42.

Third Embodiment

Next, as an exemplary implementation of the present invention, there will be described with reference to the accompanying drawings an embodiment in which the present invention is applied to a loader work vehicle as an example of a work vehicle.

Figure 6:
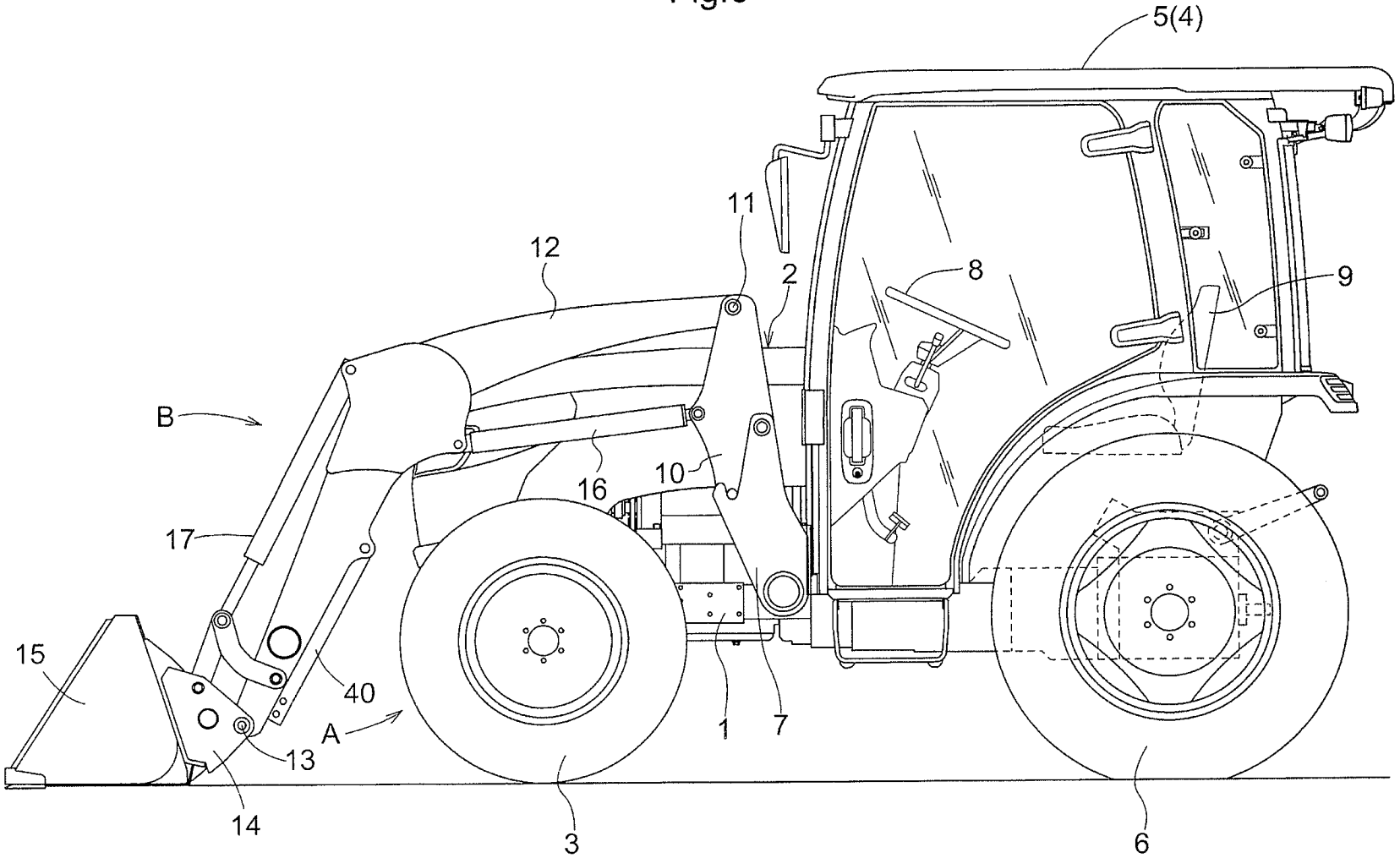
FIG. 6 is a left side view of a loader work vehicle to a third embodiment.

As shown in FIG. 6, a loader work vehicle illustrated in this embodiment is configured such that a front loader B as an example of implement B is detachably mounted to a tractor A as a traveling vehicle body A.

The tractor A includes, on the front side of a vehicle body frame 1, an engine section 2 and right and left front wheels 3, etc. The tractor A also includes, on the rear side of the vehicle body frame 1, a cabin 5 forming a riding driver's section 4 and right and left rear wheels 8, etc. At a front/rear intermediate portion of the vehicle body frame 1, there are mounted right and left support brackets 7 allowing mounting of a front loader B as an example of implement B. The riding driver's section 4 includes a steering wheel 8, a driver's seat 9, etc.

Figure 7:
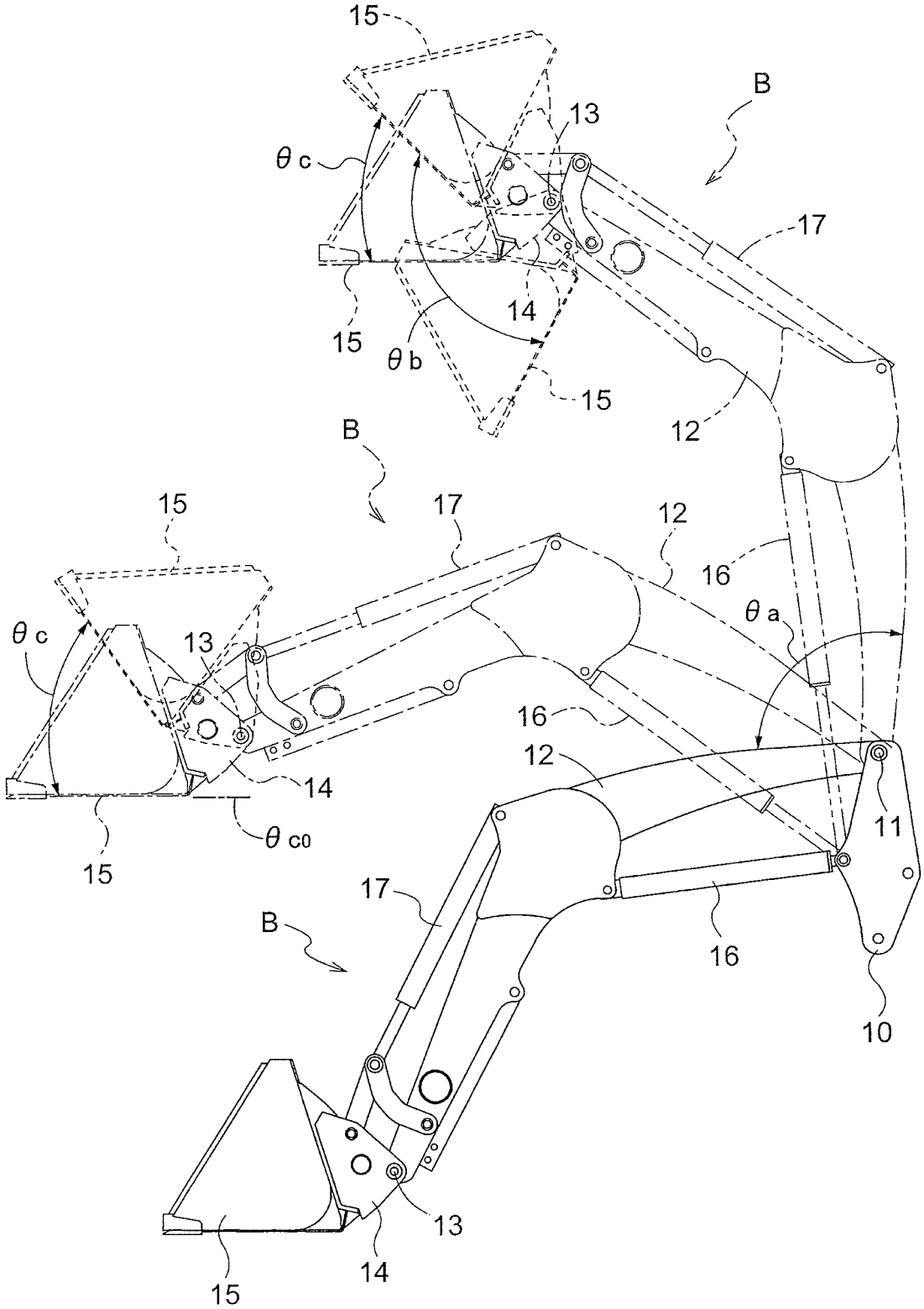
FIG. 7 is a left side view showing an operative condition of a front loader to the third embodiment.
Figure 8:
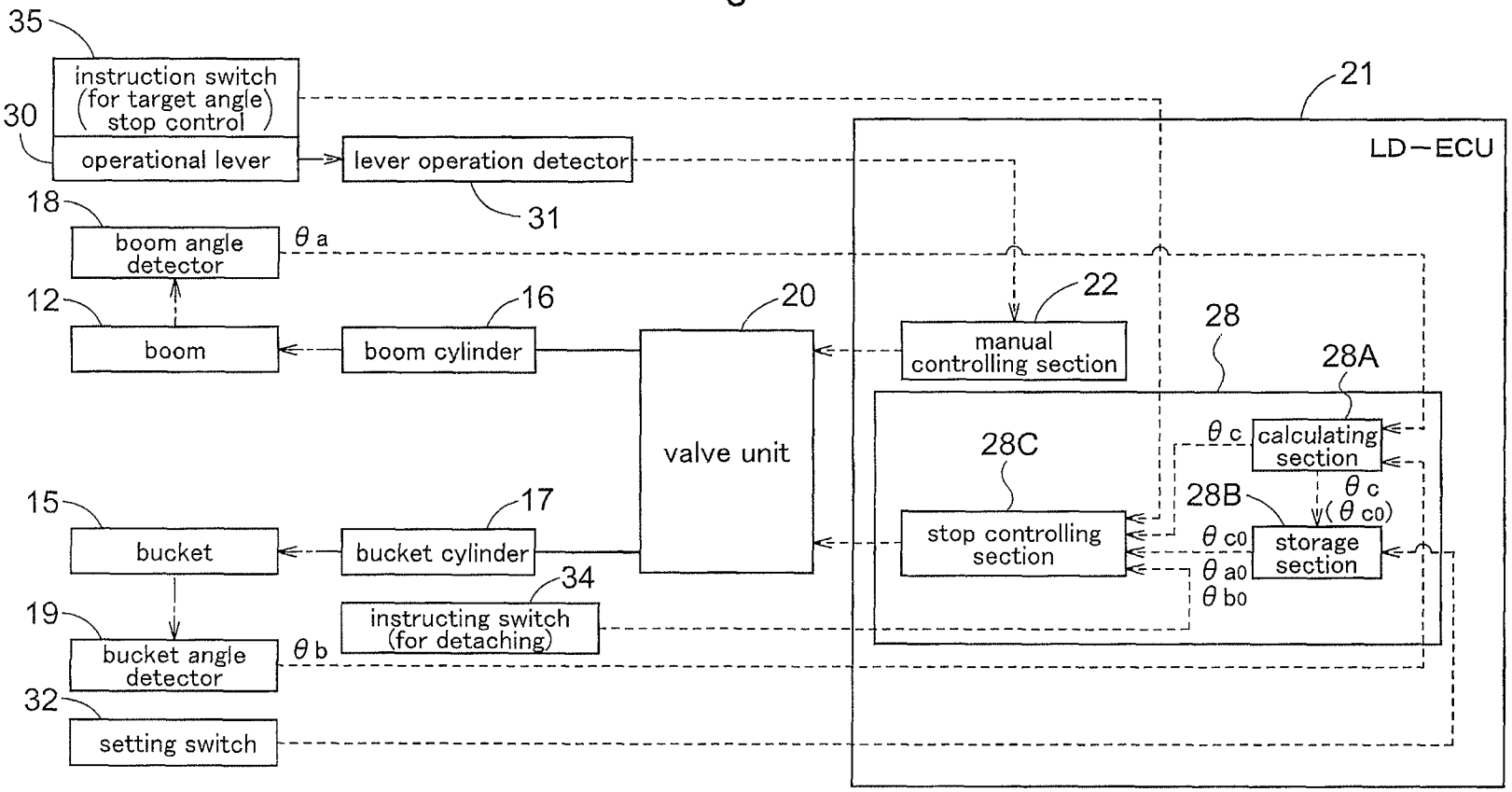
FIG. 8 is a block diagram showing a controlling configuration relating to the front loader to the third embodiment.

As shown in FIGS. 6 through 8, the front loader B includes right and left fixed brackets 10 detachably mounted on corresponding support brackets 7, right and left booms 12 vertically pivotally connected to the corresponding fixed brackets 10 via a first support shaft 11 which is oriented in the right/left direction, right and left pivot brackets 14 vertically pivotally connected to free ends of the corresponding booms 12 via a second support shaft 13 which is oriented in the right/left direction, a bucket 15 detachably attached to the right and left pivot brackets 4, hydraulic double-action type right and left boom cylinders 16 used as "boom actuators", hydraulic double-action type right and left bucket cylinders 17 used as "bucket actuators", a boom angle detector 18 as an example of pivot angle detector for detecting a vertical pivot angle (θa) of one of the right and left booms 12, a bucket angle detector 19 as an example of pivot angle detector for detecting a vertical pivot angle (θb) of the bucket 15 relative to the right and left booms 12, and so on.

The right and left boom cylinders 16 pivotally drive the corresponding booms 12 in the vertical direction about the first support shaft 11 relative to the tractor A. The right and left bucket cylinders 17 pivotally drive the bucket 15 together with the right and left pivot brackets 14 in the vertical direction about the second support shaft 13 relative to the respective booms 12. The boom angle detector 18 and the bucket angle detector 19 comprise rotary type potentiometers in this implementation.

As shown in FIG. 8, the tractor A includes a valve unit 20 for controlling flow of oil to the right and left boom cylinders 16 and the right and left bucket cylinders 17 and an electronic control unit ("LD-ECU" hereinafter) 21 for the front loader configured to control operations of the right and left boom cylinders 16 and the right and left bucket cylinders 17 via the valve control unit 20.

Though not shown, the hydraulic control unit (valve unit) 20 includes an electronic control valve for the boom configured to control flow of oil fed to the right and left boom cylinders 16, an electronic control valve for the bucket configured to control flow of oil fed to the right and left bucket cylinders 17, etc.

As shown in FIG. 7 and FIG. 8, the LD-ECU 21 comprises a microcomputer having such components as a CPU, an EEPROM, etc. And, this LD-ECU 21 includes a manual controlling section 22 enabling manual operations of the right and left booms 12 and the bucket 15, an automatic stop controlling section 28 for enabling automatic stop of the right and left booms 12 or the bucket 15 at a control target angle (θo) on priority over a control operation of the manual controlling section 22, and so on.

The manual controlling section 22 controls operations of the right and left boom cylinders 16 and the right and left bucket cylinders 17 in response to manual operations on an operational lever 30 provided in the riding driver's section 4 as an operational tool for operating the front loader. This operational lever 30 comprises a cross-pivoting, neutral-return type lever. More particularly, the manual controlling section 22 effects manual operation control for controlling the right and left boom cylinders 16 and the right and left bucket cylinders 17 based on an output from a lever operation detector 31 configured to detect an operated position of the operational lever 30.

In the manual operation control, an operated position of the operational lever 30 is determined based on an output from the lever operation detector 31. And, if this operated position of the operational lever 30 is determined as an UP position, during continuation of this operation to the UP position, the right and left boom cylinders 16 are extended to pivot the right and left booms 12 upwards. Whereas, if the operated position of the operational lever 30 is determined as a DOWN position, during continuation of this operation to the DOWN position, the right and left boom cylinders 16 are contracted to pivot the right and left booms 12 downwards. Further, if the operated position of the operational lever 30 is determined as a SCOOP position, during continuation of this operation to the SCOOP position, the right and left bucket cylinders 17 are contracted to pivot the bucket 15 upwards (scooping pivot movement). Whereas, if the operated position of the operational lever 30 is determined as a DUMP position, during continuation of this operation to the DUMP position, the right and left bucket cylinders 17 are extended to pivot the bucket 15 downwards (dumping pivot movement). Moreover, the operated position of the operational lever 30 is determined as a NEUTRAL position, while the lever is kept at this NEUTRAL position, extending operations of the right and left boom cylinders 16 and the right and left bucket cylinders 17 are stopped in order to stop any vertical pivotal movements of the right and left booms 12 and the bucket 15.

The lever operation detector 31 can employ e.g. a plurality of switches for detecting the pivotal operations of the operational lever 30 to the various operated positions, or a rotary potentiometer for detecting a pivotal operation of the operational lever 30 in the front/rear direction in combination with a further rotary potentiometer for detecting a pivotal operation of the operational lever 30 in the right/left direction.

The automatic stop controlling section 28 includes a calculating section 28A which calculates a ground pivot angle (θc) of the bucket 15 based on an output from the boom angle detector 18 and an output from the bucket angle detector 19, a storage section 28B which stores a control target angle (θo) for automatic stop of the booms 12 or the bucket 15 at a desired pivotal posture, and a stop controlling section 28C for executing a target angle stop control for automatically stopping the booms 12 or the bucket 15 at the control target angle (θo).

The storage section 24 stores the ground pivot angle (θc) of the bucket 15 outputted from the calculating section 28A as a control target angle (θco) (an example of the control target angle (θo) of the implement) for causing the bucket 15 to make automatic stop at a desired pivotal posture, if a setting switch 32 for setting control target angle provided in the riding driver's section 4 was depressed. More particularly, if the operational lever 30 was operated to actuate the right and left boom cylinders 16 and the right and left bucket cylinders 17 to operate the bucket 15 to a desired ground pivot angle (θc) and then the setting switch 32 was depressed, this ground pivot angle (θc) of the bucket 15 can be stored as the control target angle (θco) for desired angle stop in the storage section 24. Meanwhile, FIG. 7 illustrates a condition wherein the control target angle (θco) for ground angle maintaining control is set to an angle for placing the bottom face of the bucket 15 horizontal.

Further, the storage section 28B includes, as the control garget angles (θo) of the implement other than the the control target angle (θco) for stopping at a desired angle, a detaching boom target angle (θao) and a detaching bucket target angle (θbo) which are set based on respective detaching postures of the booms 12 and the bucket 15 when the right and left fixed brackets 10 of the front loader B are to be detached from the right and left brackets 7 of the traveling vehicle body A with use of right and left stands 40 provided in the right and left booms 12.

The stop controlling section 28C sets control target angles (θco) for desired angle stop as control target angle (θo) for target angle stop control. Further, when a detaching instructing switch 34 provided in the riding driver's section 4 is depressed, the control target angle (θo) for target angle stop control is switched to the detaching boom target angle (θao) and the detaching bucket target angle (θbo). And, when an instructing switch 35 for target angle stop control provided as an instruction operational tool in the gripping portion of the operational lever 30 is manually operated, the target angle stop control is executed.

The instructing switch 35 for target angle stop control is a momentary operation type, configured such that during continuation of its depression by a manual operation, the switch 35 instructs execution of the target angle stop control. Upon release of the depression by the manual operation, the switch 35 stops instructing execution of the target angle stop control.

Figure 9:
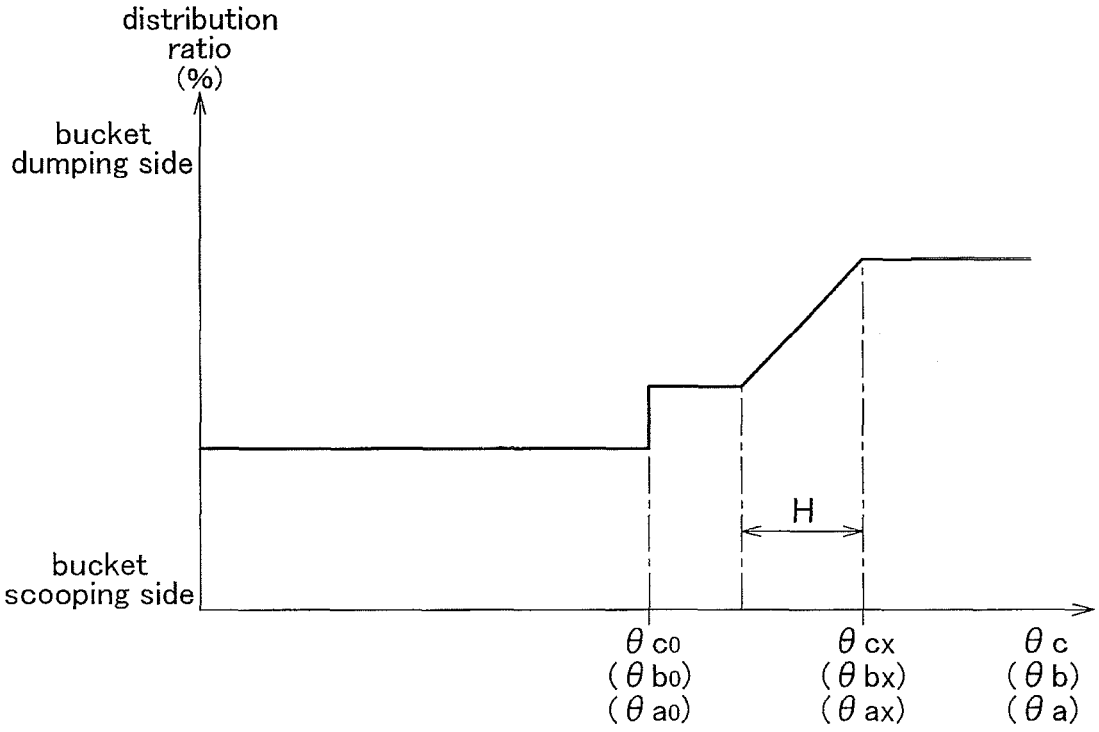
FIG. 9 is a diagram showing operational speeds at the time of automatic stop of a bucket to the third embodiment.

As shown in FIGS. 7 through 9, the stop controlling section 28C executes target angle stop control for desired angle stop for automatically stopping the bucket 15 at a desired pivotal posture as the target angle stop control during continuation of an instruction for execution of the target angle stop control by the instructing switch 35 for target angle stop control in case a control target angle (θco) for desired angle stop is set as a control target angle (θo) for target angle stop control.

Further, in case a detaching boom target angle (θao) and a detaching bucket target angle (θbo) are set as the control target angle (θo) for target angle stop control, during continuation of an instruction for execution of the target angle stop control by the instructing switch 35 for target angle stop control, as the target angle stop control, a target angle stop control for detaching is executed for automatically stopping the booms 12 and the bucket 15 at pivotal postures for front loader detachment.

In the target angle stop control for desired angle stop, if the operational lever 30 is operated during execution of this control operation, based on an output from the lever operation detector 31, it is determined whether its operated position indicates an operation suitable for moving the bucket 15 toward the control target angle (θco) for desired angle stop or not.

If it is determined that the operation is not suitable, then, an alarm device (not shown) such as a buzzer provided in the riding driver's section is activated and also the right and left boom cylinders 16 and the right and left bucket cylinders 17 are maintained under the stopped states on priority over the control operation of the manual controlling section 22 based on the manual operation on the operational lever 30.

Whereas, it is determined that the operation is suitable, then, a calculation result of the calculating section 28A is inputted and the ground pivot angle (θc) of the bucket 15 is monitored during operation of the right and left bucket cylinders 17 by a control operation by the manual controlling section 22 based on a manual operation on the operational lever 30.

Then, if it is detected based on the calculation result of the calculating section 28A that a ground pivot angle (θc) of the bucket 15 has reached a reduced speed angle (θcx) which is smaller by a set angle (e.g. 10 degrees) than the control target angle (θco) for desired angle stop, then, on priority over the control operation of the manual controlling section 22 based on a manual operation on the operational lever 30, a duty ratio for the electronic control valve for the bucket is changed so as to progressively decrease an oil distribution ratio for the right and left bucket cylinders 17 while the bucket 15 remains within a reduced speed range (H) from the reduced speed angle (θbx) to the set angle (e.g. 5 degrees), thus progressively reducing the operational speed of the right and left bucket cylinders 17 to a target speed. Then, after passage through the reduced speed range (H), the operational speed will be maintained at the target speed.

Thereafter, if it is detected based on the calculation result of the calculating section 28A that a ground pivot angle (θc) of the bucket 15 has reached the control target angle (θco) for desired angle stop, then, the right and left bucket cylinders 17 will be automatically stopped, whereby the ground pivot angle (θc) of the bucket 15 will be maintained at the control target angle (θco) for desired angle stop.

On the other hand, in case one or both of a manual operation on the operational lever 30 and a manual operation on the instructing switch 35 for target angle stop control is/are released until detection of the ground pivot angle (θc) of the bucket 15 reaching the control target angle (θco) for desired angle stop, the target angle stop control for desired angle stop will be terminated to cause the right and left bucket cylinders 17 to make automatic stop immediately, whereby the bucket 15 is automatically stopped speedily at its current pivotal posture.

That is, by effecting a manual operation on the operational tool 30 with simultaneous effecting of a manual operation on the instructing switch 35 for target angle stop control, the bucket 15 can be pivotally driven toward a desired pivotal posture such as a horizontal posture set by the instructing switch 32, and the bucket 15 can be automatically stopped at this desired pivotal posture.

With the above, even when the bucket 15 is largely pivoted for scooping or dumping, this bucket 15 can be returned easily and speedily to the desired pivotal posture such as a horizontal posture set by the instructing switch 32. Moreover, since the operational speed of the right and left bucket cylinders 17 is progressively reduced before the automatic stop of these right and left bucket cylinders 17, it is possible to alleviate the shock which occurs at the time of automatic step of the right and left bucket cylinders 17 and also to effect the automatic stop of the bucket 15 under a desired pivotal posture with high precision.

Further, for instance, if the driver takes notice of the bucket 15 being unable to make automatic stop at the desired pivotal posture due to e.g. failure of the boom angle detector 18 or the bucket angle detector 19, by releasing at least one of the manual operation of the operational lever 30 and the manual operation of the instructing switch 35, the bucket 15 can be caused to make an emergency stop speedily and reliably at its current pivotal posture.

In the target angle stop control for detaching, if a manual operation on the operational lever 30 is effected during execution of this control operation, based on an output from the bucket angle detector 19 and an output from the lever operation detector 31, it is determined whether this operation on the operational lever 30 is an appropriate operation or not.

And, under a situation of the vertical pivot angle (θb) of the bucket 15 having not yet reached the detaching bucket target angle (θbo), if it is determined that the operation is not suitable for moving the bucket 15 toward the detaching bucket target angle (θbo), then, the above-described alarm device will be activated and also the right and left boom cylinders 16 and the right and left bucket cylinders 17 will be maintained under the stopped states on priority over the control operation of the manual controlling section 22 based on the manual operation on the operational lever 30.

Conversely, if it is determined that the operation is suitable for moving the bucket 15 toward the detaching bucket target angle (θbo), then, the vertical pivot angle angle (θb) of the bucket 15 will be monitored based an output from the bucket angle detector 19 during operation of the right and left bucket cylinders 17 by e.g. control operation of the manual controlling section 22 based on the manual operation on the operational lever 30.

And, if it is detected based on the output from the bucket angle detector 19 that that a vertical pivot angle (θb) of the bucket 15 has reached a reduced speed angle (θbx) which is smaller by a set angle (e.g. 10 degrees) than the detaching bucket target angle (θco), then, on priority over the control operation of the manual controlling section 22 based on a manual operation on the operational lever 30, a duty ratio for the electronic control valve for the bucket is changed so as to progressively decrease an oil distribution ratio for the right and left bucket cylinders 17 while the bucket 15 remains within a reduced speed range (H) from the reduced speed angle (θbx) to the set angle (e.g. 5 degrees), thus progressively reducing the operational speed of the right and left bucket cylinders 17 to a target speed. Then, after passage through the reduced speed range (H), the operational speed will be maintained at the target speed.

Thereafter, if it is detected based on the output from the bucket angle detector 19 that a vertical pivot angle (θb) of the bucket 15 has reached the detaching bucket target angle (θbo), then, the right and left bucket cylinders 17 will be automatically stopped, whereby the vertical pivot angle (θb) of the bucket 15 will be maintained at the detaching bucket target angle (θbo).

On the other hand, in the situation of the vertical pivot angle (θb) of the bucket 15 having reached the detaching bucket target angle (θbo), if it is determined that the operation is not suitable for moving the right and left booms 12 toward the detaching boom target angle (θao), then, the above-described alarm device will be activated and also the right and left boom cylinders 16 and the right and left bucket cylinders 17 will be maintained under the stopped states on priority over the control operation of the manual controlling section 22 based on the manual operation on the operational lever 30.

Conversely, if it is determined that the operation is suitable for moving the right and left booms 12 toward the detaching boom target angle (θao), then, the vertical pivot angle angle (θa) of the right and left booms 12 will be monitored based an output from the boom angle detector 18 during operation of the right and left boom cylinders 16 by e.g. control operation of the manual controlling section 22 based on the manual operation on the operational lever 30.

And, if it is detected based on the output from the boom angle detector 18 that that a vertical pivot angle (θa) of the right and left booms 12 has reached a reduced speed angle (θax) which is smaller by a set angle (e.g. 10 degrees) than the detaching boom target angle (θao), then, on priority over the control operation of the manual controlling section 22 based on a manual operation on the operational lever 30, a duty ratio for the electronic control valve for the booms is changed so as to progressively decrease an oil distribution ratio for the right and left boom cylinders 16 while the right and left booms 12 remain within a reduced speed range (H) from the reduced speed angle (θax) to the set angle (e.g. 5 degrees), thus progressively reducing the operational speed of the right and left boom cylinders 16 to a target speed. Then, after passage through the reduced speed range (H), the operational speed will be maintained at the target speed.

Thereafter, if it is detected based on the output from the boom angle detector 18 that a vertical pivot angle (θa) of the right and left booms 12 has reached the detaching boom target angle (θao), then, the right and left boom cylinders 16 will be automatically stopped, whereby the vertical pivot angle (θa) of the right and left booms 12 will be maintained at the detaching boom target angle (θao).

On the other hand, in case one or both of a manual operation on the operational lever 30 and a manual operation on the instructing switch 35 for target angle stop control is/are released until detection of the vertical pivot angle (θb) of the bucket 15 reaching the detaching bucket target angle (θbo), the target angle stop control for detaching will be terminated to cause the right and left bucket cylinders 17 to make automatic stop immediately, whereby the bucket 15 is automatically stopped speedily at its current pivotal posture.

Further, in case one or both of a manual operation on the operational lever 30 and a manual operation on the instructing switch 35 for target angle stop control is/are released until detection of the vertical pivot angle (θa) of the right and left booms 12 reaching the detaching boom target angle (θao), the target angle stop control for detaching will be terminated to cause the right and left boom cylinders 16 to make automatic stop immediately, whereby the right and left booms 12 are automatically stopped speedily at their current pivotal posture.

That is, by effecting a manual operation on the operational lever 30 with simultaneous effecting of a manual operation on the instructing switch 35 for target angle stop control, the right and left booms 12 and the bucket 15 can be pivotally driven toward the predetermined detaching postures, and the right and left booms 12 and the bucket 15 can be automatically stopped under the predetermined detaching postures.

With the above, when the right and left fixed brackets 10 of the front loader B are to be detached from the right and left support brackets 7 of the traveling vehicle body A with using the right and left stands 40, the postures of the right and left booms 12 and the bucket 15 can be switched to the predetermined detaching postures easily and speedily and the bucket 15 and the right and left stands 40 can be placed onto the ground surface appropriately.

With the above, it becomes possible to avoid the possibility of damage to the right and left stands 40 due to e.g. these right and left detaching stands 40 coming into contact with the ground surface before the bucket 15, which might occur in case the right and left booms 12 are pivotally lowered in a situation where the posture of the bucket 15 is not yet switched over to the predetermined detaching posture.

Further, as the operational speeds of the right and left boom cylinders 16 and the right and left bucket cylinders 17 are progressively reduced, it is possible to alleviate the shock which occurs at the time of automatic step of the right and left boom cylinders 16 and the right and left bucket cylinders 17 and also to effect the automatic stop of the right and left booms 12 and the bucket 15 under the predetermined detaching postures with high precision.

And, for instance, if the driver takes notice of the right and left booms 12 and the bucket 15 being unable to make automatic stop at the predetermined detaching postures due to e.g. failure of the boom angle detector 18 or the bucket angle detector 19, by releasing at least one of the manual operation of the operational lever 30 and the manual operation of the instructing switch 35 for target angle stop control, the right and left boom cylinders 12 or the bucket 15 can be caused to make an emergency stop speedily and reliably at its current pivotal posture.

Other Embodiments of Third Embodiment

[1] The traveling vehicle body A can be a vehicle dedicated to loader operations, a loader-mower vehicle mounting the front loader B and a mower, a loader-excavator vehicle mounting the front loader B and a backhoe.

[2] The boom actuator 16 and the bucket actuator 17 can be hydraulic motors or the like.

[3] The operational tool 30 can comprise an operational tool for the boom only and a further operational tool for the bucket only. Further, the operational tool 30 can comprise a switch for instructing an upward pivot movement of the boom 12 a switch for instructing a downward pivot movement of the boom 12, a switch for instructing a scooping pivot movement of the bucket 15 and a switch for instructing a dumping pivot movement of the bucket 15.

[4] The instruction operational tool 35 can be mounted in the riding driver's section 4, independently of the operational tool 30.

[5] The boom angle detector 18 can comprise a sliding type potentiometer configured to detect an extended/contracted length of the boom cylinder 16 as a vertical pivot angle (θa) of the boom 12. Further, the bucket angle detector 19 can comprise a sliding type potentiometer configured to detect an extended/contracted length of the bucket cylinder 17 as a vertical pivot angle (θb) of the bucket 15.

[6] The reduced speed angles (θax), (θbx), (θcx) can vary in many ways. Each of these can be an angle which is 5 degrees or 15 degrees smaller than the respective control target angle (θo), etc.

[7] The automatic stop controlling section 28 can be configured to terminate the target angle stop control for causing the actuators 16, 17 to make automatic stop immediately only in the event of release of a manual operation on the operational tool 30 during execution of the target angle stop control until detection based, on outputs from the pivot angle detectors 16, 17, of the pivot angles (θa), (θb), (θc) of the implements 12, 15 reaching the control target angle (θo).

[8] The automatic stop controlling section 28 can be configured to terminate the target angle stop control for causing the actuators 16, 17 to make automatic stop immediately only in the event of release of a manual operation on the instruction operational tool 35 during execution of the target angle stop control until detection based, on outputs from the pivot angle detectors 16, 17, of the pivot angles (θa), (θb), (θc) of the implements 12, 15 reaching the control target angle (θo).

[9] The automatic stop controlling section 28 can be configured to terminate the target angle stop control for causing the actuators 16, 17 to make automatic stop immediately only in the event of release of both a manual operation on the operational tool 30 and a manual operation on the instruction operational tool 35 during execution of the target angle stop control until detection based, on outputs from the pivot angle detectors 16, 17, of the pivot angles (θa), (θb), (θc) of the implements 12, 15 reaching the control target angle (θo).

According to the third embodiment, a front loader comprises:

a boom actuator configured to pivotally drive a boom along a vertical direction relative to a traveling vehicle body about a first pivot axis which is oriented along a right/left direction;

a bucket actuator configured to pivotally drive a bucket along the vertical direction relative to the boom about a second pivot axis which is oriented along the right/left direction;

a manual controlling section for controlling operations of the boom actuator and the bucket actuator based on a manual operation of an operational tool;

a boom angle detector for detecting a vertical pivot angle of the boom;

a bucket angle detector for detecting a vertical pivot angle of the bucket relative to the boom;

a calculating section for calculating a ground pivot angle (i.e. pivot angle relative to the ground surface) of the bucket based on an output from the boom angle detector and an output from the bucket angle detector;

a storage section storing relation data representing relation between a vertical pivot angle of the boom and a limit scoop angle of the bucket;

a setting section for setting the limit scoop angle corresponding to a vertical pivot angle of the boom, based on the output from the boom angle detector and the relation data; and a scoop angle limit controlling section configured to control an operation of the bucket actuator in such a manner that the ground pivot angle of the bucket will not exceed the set limit scoop angle when arrival of the ground pivot angle of the bucket at the set limit scoop angle is detected based on an output from the setting section and an output from the calculating section.

With the above-described configuration, for instance, if the relation data may set, for a large vertical pivot angle of the boom, the limit scoop angle to a constant angle capable of preventing drop of a scooped object from the bucket to the boom side and may set, for a small vertical pivot angle of the boom, the limit scoop angle to an angle greater than the drop preventing angle as long as this angle allows prevention of accidental contact of the bucket with the boom. With the above setting, through control operation of the scoop angle limit controlling section based on an output from the setting section and an output from the calculating section, when the bucket is located at a relatively low position, it is possible to pivot this bucket largely even if the boom is currently in the course of its upward movement. Consequently, it becomes possible to effect in a favorable manner a scooping operation of a scooping object e.g. earth or sand which is present at a position higher than the ground surface.

And, after completion of the above scooping operation, when the boom is further pivoted upwards for conveying the scooped object, the ground pivot angle of the bucket is limited to the limit scoop angle for drop prevention, so that it is possible to avoid occurrence of inconvenient dropping of the scooped object from the bucket to the boom side during the conveying.

Moreover, after completion of the scooping operation, when the boom is pivoted downwards with the bucket being largely pivoted for scooping, in association with approaching of the bucket to the boom with this downward pivotal movement of the latter, the bucket actuator will be actuated under the control operation of the scoop angle limit controlling section, the above downward pivotal movement of the boom is allowed to proceed with automatic avoidance of e.g. accidental contact between the boom and the bucket.

Therefore, when the bucket is located at a relatively low position, this bucket can be pivoted largely for scooping and also dropping of scooped object during conveyance from the bucket to the boom can be prevented. Moreover, even when the boom is downwardly pivoted with the bucket being largely pivoted, this downward pivot movement of the boom is allowed to proceed smoothly without inviting e.g. accidental contact between the boom and the bucket. In this way, there has been realized the intended front loader having improved operability.

In the above configuration, preferably, in the relation data, if the vertical pivot angle of the boom is greater than the set angle, the limit scoop angle of the bucket is limited to be smaller than a first predetermined angle capable of preventing dropping of a scooped object from the bucket to the boom side. With this configuration, it is possible to prevent dropping of a scooped object due to the vertical pivot angle of the bucket becoming too large. Further, preferably, in the relation data, if the vertical pivot angle of the bucket is smaller than the set angle, the limit scoop angle of the bucket to limited to be smaller than a second predetermined angle which is greater than the first predetermined angle. With this configuration, when the height position of the bucket is relatively low, the bucket can be pivoted largely for scooping even if the boom is currently in the course of its elevation. As a result, a scooping operation can be carried out favorably on a scooping target such as earth/sand which is present at a position higher than the ground surface. Further, preferably, the second predetermined angle is set to an angle at which the bucket does not come into contact with the boom. With this configuration, inadvertent contact between the boom and the bucket can be avoided.

According to one preferred solution provided by the present invention, the front loader further comprises:

a ground angle maintaining controlling section for controlling the operation of the bucket actuator such that a ground pivot angle of the bucket may be maintained constant irrespective of any vertical pivotal movement of the boom;

wherein the manual controlling section controls the operation of the bucket actuator on priority over the ground angle maintaining controlling section; and the scoop angle limit controlling section controls the operation of the bucket actuator on priority over the ground angle maintaining controlling section and the manual controlling section.

With the above-described solution, with the control operation by the ground angle maintaining controlling section, the ground pivot angle of the bucket can be maintained constant, irrespective of any vertical pivotal movement of the boom. Thus, the prevention of dropping of scooped object from the bucket can be realized in an even more favorable manner.

And, while the ground pivot angle of the bucket is being maintained constant with the control operation by the ground angle maintaining controlling section, if there arises a need to pivot the bucket for a scooping operation or a dumping operation, the bucket can be readily pivoted for the scooping or dumping operation by a manual operation on the operational tool.

And, under both the condition of the ground pivot angle being maintained constant irrespective of vertical pivotal movement of the boom and the condition of the bucket being pivoted for scooping or dumping by a manual operation on the operational tool, prevention of dropping of scooped object from the bucket and inadvertent contact between the boom and the bucket can be realized in a favorable manner, thanks to the control operation by the scoop angle limit controlling section based on an output from the setting section and an output from the calculating section.

Therefore, it is possible to provide a front loader with further improved operability that allows maintaining the ground pivot angle of the bucket constant, yet allowing also a pivotal operation of the bucket on priority over this maintenance, allowing also effective prevention of dropping of scooped object form the bucket and accidental contact between the boom and the bucket.

In the above configuration, preferably, the storage section stores information relating to target ground pivot angles for ground angle maintaining control. With this configuration, the ground angle maintaining controlling section can execute the ground angle maintaining control in a reliable manner based on the information stored in the storage section.

In the above configuration, preferably, a ground pivot angle outputted from the calculating section when a predetermined operational tool is operated by a rider's operation on this operational tool is stored as the target ground pivot angle in the storage section. With this configuration, a target ground pivot angle can be set by a simple operation.

In the above configuration, preferably, the ground angle maintaining controlling section executes the control such that the ground pivot angle may be confined within a non-sensitive range which is a predetermined range from the target ground pivot angle. With this configuration, it becomes possible to reduce the control frequency, thereby smoothing the bucket movement.

According to a further preferred solution provided by the present invention, the relation data is set such that the closer the vertical pivot angle of the boom to the set angle, the greater the limit scoop angle of the bucket, in case the vertical pivot angle of the boom is smaller than the set angle, whereas the limit scoop angle of the bucket is maintained at a constant angle allowing prevention of dropping of scooped object from the bucket to the boom side in case the vertical pivot angle of the boom exceeds the set angle.

This relation data is set in consideration of the observations that in case the boom is vertically pivoted with the ground pivot angle of the bucket being maintained constant, the relative angle between the boom and the bucket becomes larger as the boom is pivoted more upwards, thus making it difficult for the bucket to contact the boom or the like; whereas, conversely, the relative angle between the boom and the bucket becomes smaller as the boom is pivoted more downwards, thus making it easy for the bucket to contact the boom or the like and also that in case the boom is vertically pivoted with the relative angle between the boom and the bucket being maintained constant, the ground pivot angle of the bucket becomes larger as the boom is pivoted more upwards; whereas, conversely, the ground pivot angle of the bucket becomes smaller as the boom is pivoted more downwards.

With the above-described solution, when the bucket is located at a relatively low position, this bucket can be pivoted largely for scooping and also dropping of scooped object during conveyance from the bucket to the boom can be prevented. Moreover, even when the boom is downwardly pivoted with the bucket being largely pivoted, this downward pivot movement of the boom is allowed to proceed smoothly without inviting e.g. accidental contact between the boom and the bucket.

Fourth Embodiment

Next, as an exemplary implementation of the present invention, a front loader relating to the present invention will be described with reference to the accompanying drawings by way of a first embodiment wherein the front loader is mounted to a tractor as an example of a traveling vehicle body.

Figure 10:
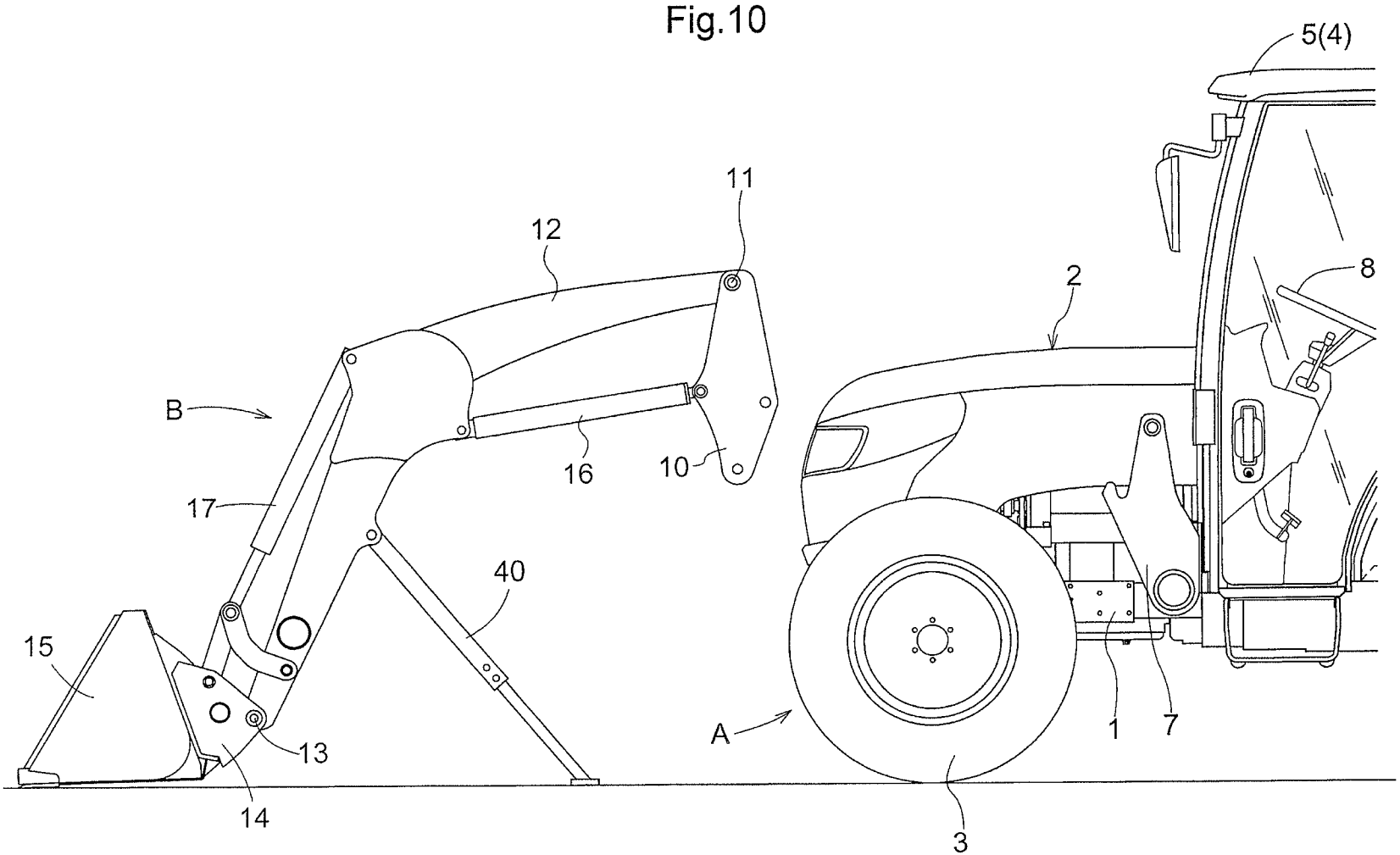
FIG. 10 is a left side view of the loader work vehicle under a detached state of the front loader to the third embodiment.

As shown in FIG. 10, a tractor A as an example of a traveling vehicle body in the first embodiment includes, on the front side of a vehicle body frame 1, an engine section 2 and right and left front wheels 3, etc. The tractor A also includes, on the rear side of the vehicle body frame 1, a cabin 5 forming a riding driver's section 4 and right and left rear wheels 8, etc. At a front/rear intermediate portion of the vehicle body frame 1, there are mounted right and left support brackets 7 allowing mounting of a front loader B. The riding driver's section 4 includes a steering wheel 8, a driver's seat 9, etc.

Figure 11:
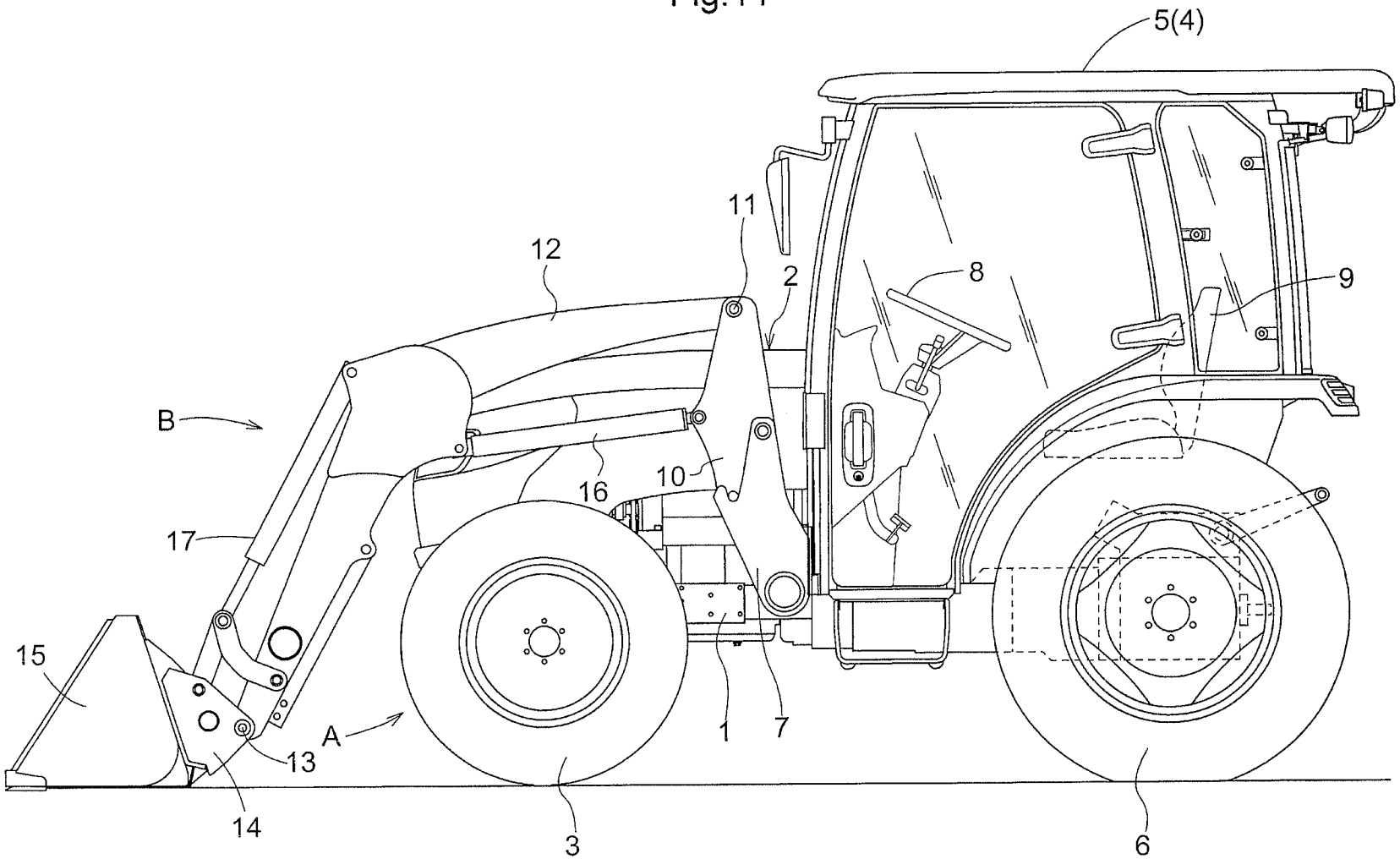
FIG. 11 is a left side view of a tractor mounting a front loader to a fourth embodiment.
Figure 12:
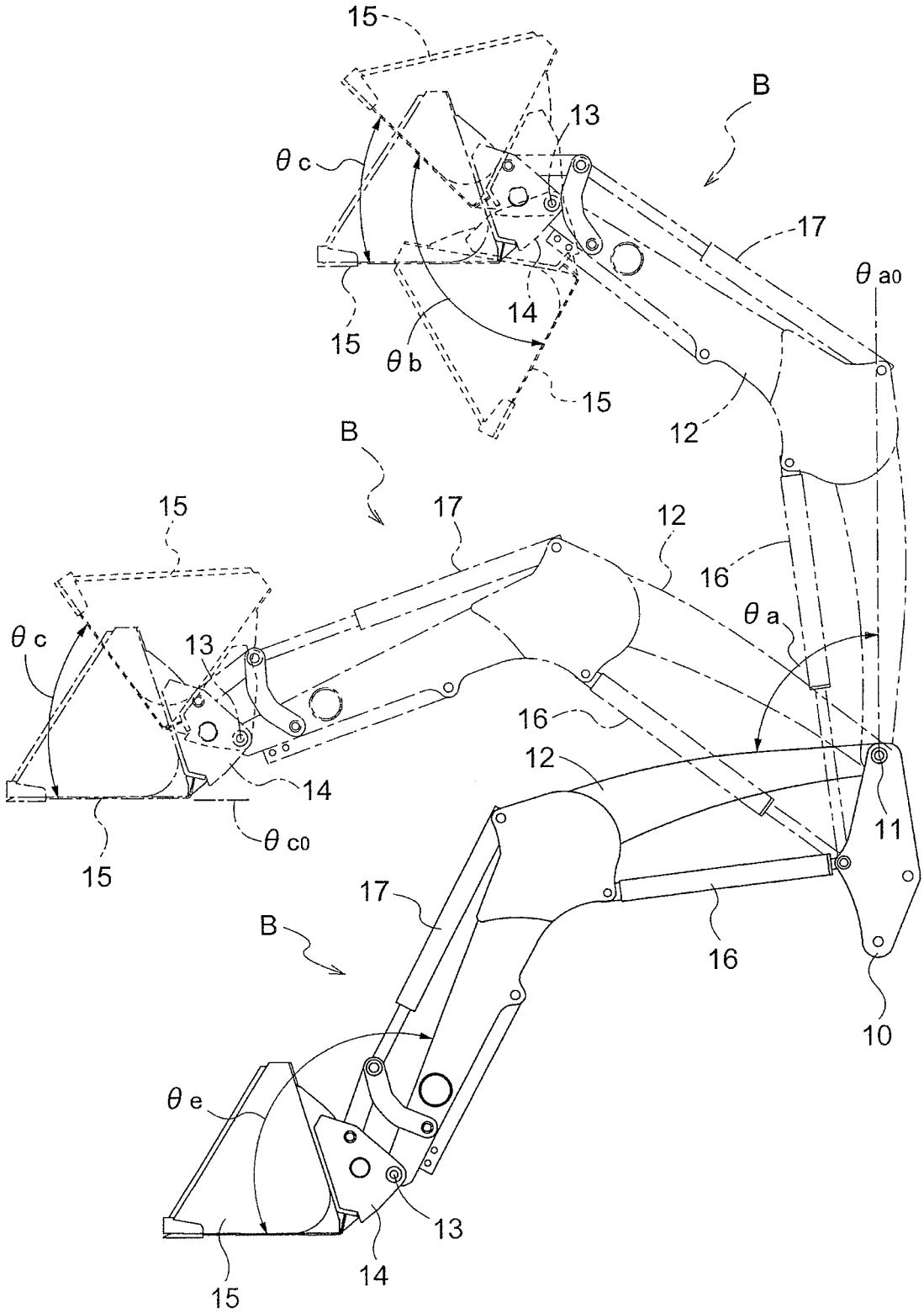
FIG. 12 is a left side view showing an operative condition of the front loader to the fourth embodiment.
Figure 13:
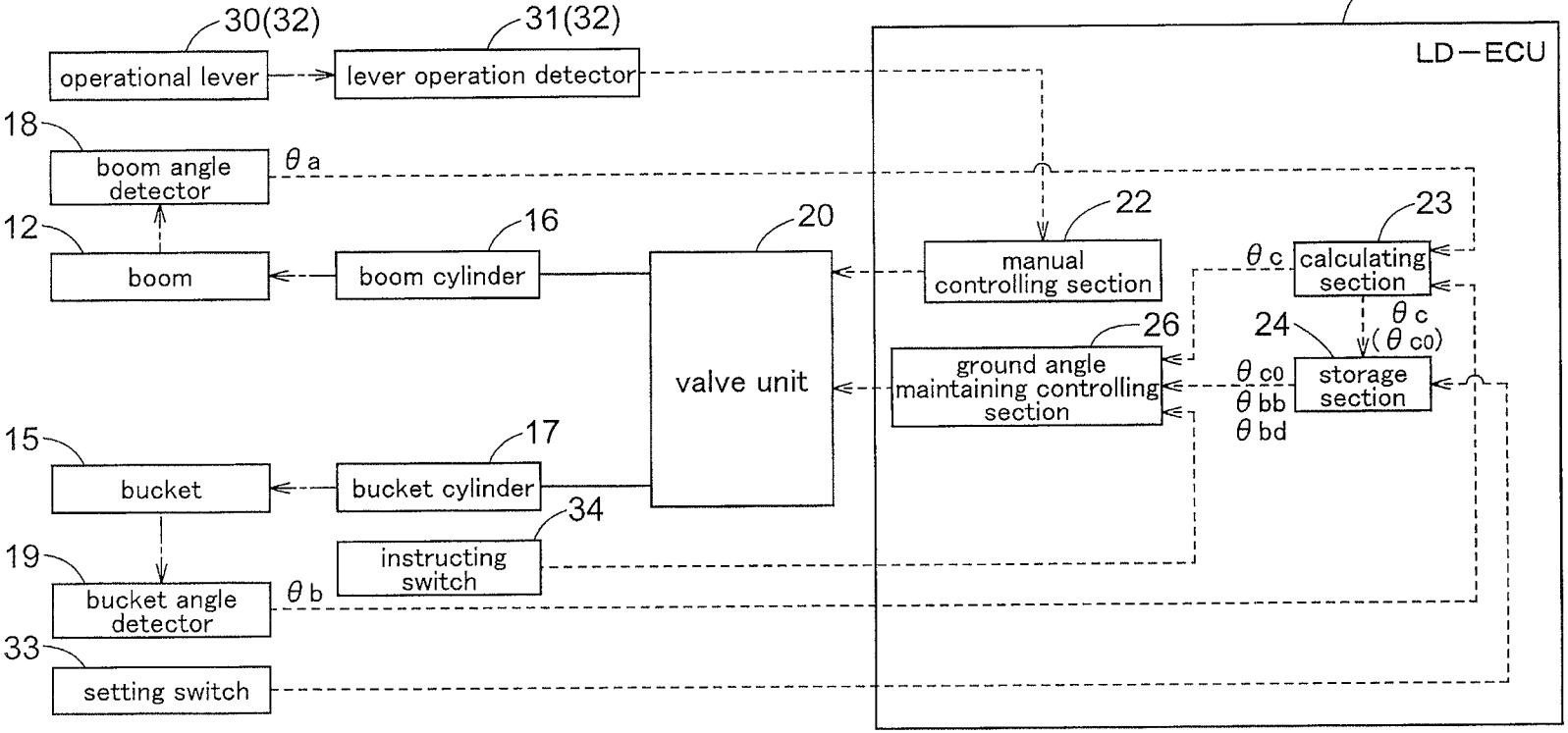
FIG. 13 is a block diagram showing a controlling configuration relating to the front loader to the fourth embodiment.

As shown in FIGS. 11 through 13, the front loader B includes right and left fixed brackets 10 detachably mounted on corresponding support brackets 7, right and left booms 12 vertically pivotally connected to the corresponding fixed brackets 10 via a first support shaft 11 which is oriented in the right/left direction, right and left pivot brackets 14 vertically pivotally connected to free ends of the corresponding booms 12 via a second support shaft 13 which is oriented in the right/left direction, a bucket 15 detachably attached to the right and left pivot brackets 4, hydraulic double-action type right and left boom cylinders 16 used as "boom actuators", hydraulic double-action type right and left bucket cylinders 17 used as "bucket actuators", a boom angle detector 18 for detecting a vertical pivot angle (θa) of one of the right and left booms 12, a bucket angle detector 19 for detecting a vertical pivot angle (θb) of the bucket 15 relative to the right and left booms 12, and so on.

The right and left boom cylinders 16 pivotally drive the corresponding booms 12 in the vertical direction about the first support shaft 11 relative to the tractor A. The right and left bucket cylinders 17 pivotally drive the bucket 15 together with the right and left pivot brackets 14 in the vertical direction about the second support shaft 13 relative to the respective booms 12. The boom angle detector 18 and the bucket angle detector 19 comprise rotary type potentiometers in this implementation.

As shown in FIG. 13, the tractor A includes a valve unit 20 for controlling flow of oil to the right and left boom cylinders 16 and the right and left bucket cylinders 17 and an electronic control unit ("LD-ECU" hereinafter) 21 for the front loader configured to control operations of the right and left boom cylinders 16 and the right and left bucket cylinders 17 via the valve control unit 20.

Though not shown, the hydraulic control unit (valve unit) 20 includes an electronic control valve for the boom configured to control flow of oil fed to the right and left boom cylinders 16, an electronic control valve for the bucket configured to control flow of oil fed to the right and left bucket cylinders 17, etc.

As shown in FIG. 12 and FIG. 13, the LD-ECU 21 comprises a microcomputer having such components as a CPU, an EEPROM, etc. And, this LD-ECU 21 includes a manual controlling section 22 enabling manual operations of the right and left booms 12 and the bucket 15, a calculating section 23 for effecting various calculations, a storage section 24 for storing various kinds of data, a setting section 25 for setting a limit scoop angle of the bucket, a ground angle maintaining controlling section 26 for effecting ground angle maintaining control for maintaining a ground pivot angle (θc) of the bucket 15 constant, and so on.

The manual controlling section 22 effects a manual operation control for controlling operations of the right and left boom cylinders 16 and the right and left bucket cylinders 17, in response to an operational instruction outputted from an instruction operational tool 32 for operating the front loader, comprised of a cross-pivoting, neutral-return type operational lever 30 provided in the riding driver's section 4 for operating the front loader and a lever operation detector 31 for detecting an operated position of the operational lever 30.

In the manual operation control, if an operational instruction outputted from the instruction operational tool 32 is an operational instruction for boom elevation, during continuation of the output of this operational instruction, the right and left boom cylinders 16 are extended to pivot the right and left booms 12 upwards. Whereas, if the operational instruction outputted from the instruction operational tool 32 is an operational instruction for boom lowering, during continuation of the output of this operational instruction, the right and left boom cylinders 16 are contracted to pivot the right and left booms 12 downwards. Further, if the operational instruction outputted from the instruction operational tool 32 is an operational instruction for bucket elevation, during continuation of the output of this operational instruction, the right and left bucket cylinders 17 are contracted to pivot the bucket 15 upwards (scooping pivot movement). Whereas, if the operational instruction outputted from the instruction operational tool 32 is an operational instruction for bucket lowering, during continuation of the output of this operational instruction, the right and left bucket cylinders 17 are extended to pivot the bucket 15 downwards (dumping pivot movement). Moreover, if output of any operational instruction from the instruction operational tool 32 is stopped, during continuation of this stop of output, extending operations of the right and left boom cylinders 16 and the right and left bucket cylinders 17 are stopped in order to stop any vertical pivotal movements of the right and left booms 12 and the bucket 15.

The lever operation detector 31 can employ e.g. a plurality of switches for detecting the pivotal operations of the operational lever 30 to the various operated positions, or a rotary potentiometer for detecting a pivotal operation of the operational lever 30 in the front/rear direction in combination with a further rotary potentiometer for detecting a pivotal operation of the operational lever 30 in the right/left direction.

The calculating section 23 calculates a ground pivot angle (θc) of the bucket 15 based on an output from the boom angle detector 18 and an output from the bucket angle detector 19 and then outputs this calculation result to the storage section 24, the ground angle maintaining controlling section 26, and the scoop angle limit controlling section 27, etc.

The storage section 24 stores the ground pivot angle (θc) of the bucket 15 outputted from the calculating section 23 as a control target angle (θco) if a setting switch 32 for setting control target angle provided in the riding driver's section 4 was depressed. More particularly, if the operational lever 30 was operated to actuate the right and left boom cylinders 16 and the right and left bucket cylinders 17 to operate the bucket 15 to a desired ground pivot angle (θc) and then the setting switch 32 was depressed, this ground pivot angle (θc) of the bucket 15 can be stored as the control target angle (θco) for ground angle maintaining control in the storage section 24. Meanwhile, FIG. 12 illustrates a condition wherein the control target angle (θco) for ground angle maintaining control is set to an angle for placing the bottom face of the bucket 15 horizontal.

Further, there are also stored elevation restricted angles (θbb) set slightly smaller, by a set angle (e.g. 2 degrees) than elevation limit angles (θba) of the bucket 15 and lowering restricted angles (θbd) set slightly smaller, by a set angle (e.g. 2 degrees) than lowering limit angles (θbc) of the bucket 15.

Figure 14:
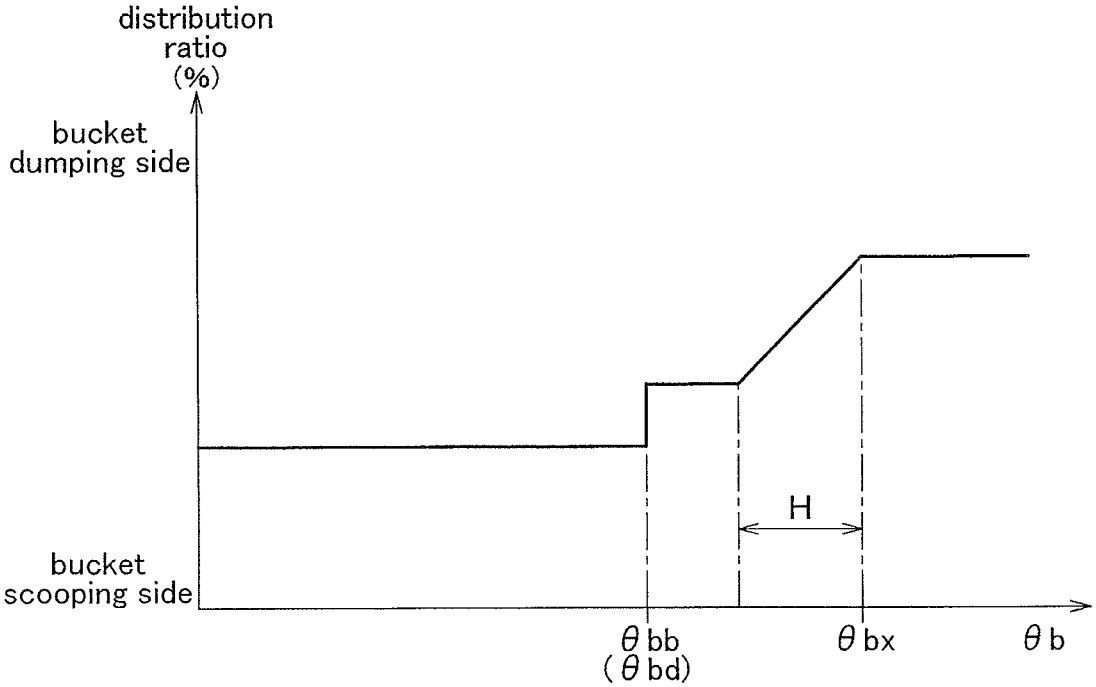
FIG. 14 is a view showing operational speeds at the time of automatic stop of bucket to the fourth embodiment.

As shown in FIGS. 12 through 14, the ground angle maintaining controlling section 26 effects ground angle maintaining control in case an instruction switch 34 for ground angle maintaining control provided in the riding driver's section 4 is depressed during stop of execution of the ground angle maintaining control. Also, this ground angle maintaining control is terminated if the instruction switch 34 for ground angle maintaining control is depressed during execution of ground angle maintaining control.

In the ground angle maintaining control, firstly, based on an output from the boom angle detector 18, determination is made whether the vertical pivot angle (θa) of the right and left booms 12 under stopped state thereof is within a set angle range (e.g. 2 degrees) from the elevation limit angles (θao) of the right and left booms 12 or not.

Thereafter, when the instruction operational tool 32 outputs a boom lowering operational instruction, irrespectively of the result of the above determination, before the manual controlling section 22 initiates a lowering control operation for the right and left boom cylinders 16 based on the above operational instruction, an elevation control operation for the right and left bucket cylinders 17 is initiated. And, based on the control target angle (θco) for ground angle control stored in the storage section 24 and the control target angle (θco) for the bucket 15 outputted from the calculating section 23, operations of the right and left bucket cylinders 17 are controlled such that the ground pivot angle (θc) of the bucket 15 may agree to the control target angle (θco) for the ground angle control (be present within a non-sensitive range of the control target angle (θco)), irrespective of lowering pivotal movement of the right and left booms 12.

Conversely, when the instruction operational tool 32 outputs a boom elevation operational instruction, the result of the above determination is reflected and if the determination result indicates the angle being outside the set angle range, then, based on this operational instruction, lowering control operation for the right and left bucket cylinders 17 will be initiated before the manual controlling section 22 initiates elevation controlling operation for the right and left boom cylinders 16 based on the above operational instruction.

Moreover, if the determination result indicates the angle being within the set angle range, then, no control operation for the right and left bucket cylinders 17 is effected and the bucket 15 is maintained under its current pivotal posture.

Namely, when the instruction operational tool 32 outputs a boom lowering operational instruction and also when the instruction operational tool 32 outputs a boom elevation operational instruction in the case of the vertical pivot angle (θa) of the right and left booms 12 under stopped state thereof being within the set angle from the elevation limit angles (θbo) of the right and left booms 12, through combination of the feedforward control and the feedback control, the ground pivot angle (θc) of the bucket 15 can be maintained at the the control target angle (θco) for the ground angle maintaining control (a desired ground pivot angle) with high precision, without inviting control delay in the bucket actuator.

Further, when the instruction operational tool 32 outputs a boom elevation operational instruction and also when the instruction operational tool 32 outputs a boom elevation operational instruction in the case of the vertical pivot angle (θa) of the right and left booms 12 under stopped state thereof being within the set angle from the elevation limit angles (θbo) of the right and left booms 12, by not effecting any feedforward control, it is possible to avoid occurrence of inconvenience of the ground pivot angle (θc) of the bucket 15 deviating significantly from the control target angle (θco) for the ground angle maintaining control, due to preceding lowering pivotal movement of the bucket 15 in spite of the inability of the right and left booms 12 to pivotally move upwards.

With the ground angle controlling section 26, in the ground angle maintaining control, in addition to the above-described control operations, based on an output from the bucket angle detector 18 and the elevation restricted angle (θbb) and the lowering restricted angle (θbd) both stored at the storage section 24, if it is detected that the vertical pivot angle (θb) of the bucket 15 has reached a reduced speed angle (θbx) smaller by a set angle (e.g. 10 degrees) than the elevation restricted angle (θbb) or the lowering restricted angle (θbd); then, on priority over the control operation of the manual controlling section 22 based on an operational instruction from the instruction operating tool 32, a duty ratio for the electronic control valve for the bucket is changed so as to progressively decrease an oil distribution ratio for the right and left bucket cylinders 17 while the bucket 15 remains within a reduced speed range (H) from the reduced speed angle (θbx) to the set angle (e.g. 5 degrees), thus progressively reducing the operational speed of the right and left bucket cylinders 17 to a target speed. Then, after passage through the reduced speed range (H), the operational speed will be maintained at the target speed.

Thereafter, when it is detected that the vertical pivot angle (θb) of the bucket 15 has reached the elevation restricted angle (θbb) or the lowering restricted angle (θbd); then, the right and left bucket cylinders 17 will be automatically stopped, whereby the vertical pivot angle (θb) of the bucket 15 will be maintained at the elevation restricted angle (θbb) or the lowering restricted angle (θbd).

With the above-described arrangement, in the ground angle maintaining control, it is possible to avoid occurrence of inconvenience of a relief valve provided in the valve unit 20 being activated to reduce the amount of oil fed to the right and left boom cylinders 16, thus inadvertently reducing the driving speed of the booms 12, due to the vertical pivot angle (θb) of the bucket 15 reaching the elevation restricted angle (θba) or the lowering restricted angle (θbc).

Moreover, as the operational speed of the right and left bucket cylinders 17 is progressively reduced prior to the automatic stop, it is possible to restrict occurrence of shock at the time of automatic stop, thus allowing increase in stopping precision of the bucket at the the elevation restricted angle (θbb) or the lowering restricted angle (θbd).

Though not shown, the storage section 24 may be configured to store relation data representing relation among the vertical pivot angles (θa) of the booms 12, the elevation restricted angles (θcb) set slightly smaller, by a set angle than the elevation limit angles (θca) of the bucket 15 relative to the ground pivot angles (θc) of the bucket 15, and the lowering restricted angles (θbd) set slightly smaller, by a set angle than the lowering limit angles (θcc) of the bucket 15. And, a setting section may be provided for setting the elevation restricted angle (θcb) and the lowering restricted angle (θbd) of the bucket 15 in accordance with the vertical pivot angle (θa) of the booms 12, based on such relation data and an output from the boom angle detector 18. And, when the ground angle maintaining controlling section 26 detects that the vertical pivot angle (θb) of the bucket 15 has reached the elevation restricted angle (θcb) or the lowering restricted angle (θcd), the right and left bucket cylinders 17 may be stopped automatically.

Other Embodiments of the Forth Embodiment

[1] The traveling vehicle body A can be a vehicle dedicated to loader operations, a loader-mower vehicle mounting the front loader B and a mower, a loader-excavator vehicle mounting the front loader B and a backhoe.

[2] The boom actuator 16 and the bucket actuator 17 can be hydraulic motors or the like.

[3] The instruction operational tool 32 can comprise an operational tool for the boom only and a further operational tool for the bucket only. Further, the instruction operational tool 32 can comprise a switch for instructing an upward pivot movement of the boom 12 a switch for instructing a downward pivot movement of the boom 12, a switch for instructing a scooping pivot movement of the bucket 15 and a switch for instructing a dumping pivot movement of the bucket 15.

[4] The boom angle detector 18 can comprise a sliding type potentiometer configured to detect an extended/contracted length of the boom cylinder 16 as a vertical pivot angle (θa) of the boom 12. Further, the bucket angle detector 19 can comprise a sliding type potentiometer configured to detect an extended/contracted length of the bucket cylinder 17 as a vertical pivot angle (θb) of the bucket 15.

[5] The set angle from the elevation restricted angle (θao) of the boom 12 where the ground angle maintaining controlling section 26 effects no control operation for the bucket actuator 17 can vary in many ways as long as no inconvenience occurs in maintaining the ground pivot angle (θc) of the bucket 15 constant. For instance, the set angle can be 3 degrees, 4 degrees, etc.

According to the fourth embodiment, a front loader comprises:

a boom actuator configured to pivotally drive a boom along a vertical direction relative to a traveling vehicle body about a first pivot axis which is oriented along a right/left direction;

a bucket actuator configured to pivotally drive a bucket along the vertical direction relative to the boom about a second pivot axis which is oriented along the right/left direction;

a boom angle detector for detecting a vertical pivot angle of the boom;

a bucket angle detector for detecting a vertical pivot angle of the bucket relative to the boom;

a calculating section for calculating a ground pivot angle (i.e. pivot angle relative to the ground surface) of the bucket based on an output from the boom angle detector and an output from the bucket angle detector;

a manual controlling section for controlling operations of the boom actuator and the bucket actuator based on an operational instruction outputted from an instruction operational tool; and a ground angle maintaining controlling section for controlling the operation of the bucket actuator based on an output from the calculating section such that a ground pivot angle of the bucket may be maintained constant irrespective of any vertical pivotal movement of the boom;

wherein the ground angle maintaining controlling section is configured such that:

determination of whether a vertical pivot angle of the boom is within a set angle range measured from an elevation limit angle of the boom or not is made under a stopped state of the boom;

when the instruction operational tool outputs an operational instruction for boom lowering, irrespective of result of said determination, based on this operational instruction, an elevation control operation for the bucket actuator is initiated, prior to initiation of a lowering control operation for the boom actuator by the manual controlling section;

when the instruction operational tool outputs an operational instruction for boom elevation, if the determination results indicates the vertical pivot angle being outside said set angle range, based on said operational instruction, a lowering control operation for the bucket actuator is initiated, prior to initiation of an elevation control operation for the boom actuator by the manual controlling section;

whereas, if the determination results indicates the vertical pivot angle being within said set angle range, the lowering control operation for the bucket actuator is not effected.

With the above-described configuration, when the boom is to be pivotally lowered, the ground angle maintaining controlling section effects a feedforward control effected based on an operational instruction for boom lowering outputted from the instruction operational tool for initiating an elevation control operation for the bucket actuator prior to initiation of a lowering control operation for the boom actuator by the manual controlling section and effects also a feedback control effected based on an output from the calculating section for controlling operation of the bucket actuator so as to maintain the ground pivot angle of the bucket constant, irrespective of any vertical pivotal movement of the boom.

Also, when the boom is to be pivotally elevated when the vertical pivot angle of the boom under its stopped state is outside the set angle range measured from an elevation limit angle of the boom, the ground angle maintaining controlling section effects a feedforward control effected based on an operational instruction for boom elevation outputted from the instruction operational tool for initiating a lowering control operation for the bucket actuator prior to initiation of an elevation control operation for the boom actuator by the manual controlling section and effects also the feedback control effected based on an output from the calculating section for controlling operation of the bucket actuator so as to maintain the ground pivot angle of the bucket constant, irrespective of any vertical pivotal movement of the boom.

Further, if a pivotal elevation of the boom is attempted when the vertical pivot angle of the boom under its stopped state is within the set angle range, the ground angle maintaining controlling section effects no control operation for the bucket actuator.

Namely, in the case of pivotal lowering of the boom and also in the case of pivotal elevation of the boom when the vertical pivot angle of the boom under its stopped state is outside the set angle range, through combination of the feedforward control and the feedback control, the ground pivot angle of the bucket can be maintained constant with high precision, without inviting control delay in the bucket actuator.

Further, in the case of pivotal elevation of the boom being attempted when the vertical pivot angle of the boom under its stopped state is within the set angle range, no feedforward control is effected. With this, it is possible to avoid occurrence of inconvenience of inability to maintain the ground pivot angle of the bucket constant due to preceding pivotal lowering of the bucket in spite of the boom being hardly pivotable upwards as being located within the set angle range measured from the elevation limit angle of the boom.

Consequently, it is possible to maintain a ground pivot angle of the bucket constant with higher precision, irrespective of any vertical pivotal movement of the boom.

In the above configuration, preferably, a feedforward control is effected based on an operational instruction for boom lowering outputted from the instruction operational tool and then shift is made from the feedforward control to the feedback control. With this configuration, at the early stage, by the feedforward control, the bucket can be maintained to a desired ground pivot angle speedily. And, thereafter, by the feedback control, based on the actual ground pivot angle of the bucket, the ground pivot angle of the bucket can be maintained reliably.

In the above configuration, preferably, if the determination results indicates the vertical pivot angle being outside the set angle range, based on an operational instruction for boom elevation outputted from the instruction operational tool, the feedforward control is effected and then shift is made from the feedforward control to the feedback control. With this configuration, at the early stage, by the feedforward control, the bucket can be maintained to a desired ground pivot angle speedily. And, thereafter, by the feedback control, based on the actual ground pivot angle of the bucket, the ground pivot angle of the bucket can be maintained reliably.

In the above configuration, preferably, a storage section is provided for storing information relating to target ground pivot angles for ground angle maintaining control. With this configuration, the ground angle maintaining controlling section can execute the ground angle maintaining control in a reliable manner based on the information stored in the storage section.

In the above configuration, preferably, a ground pivot angle outputted from the calculating section when a predetermined operational tool is operated by a rider's operation on this operational tool is stored as the target ground pivot angle in the storage section. With this configuration, a target ground pivot angle can be set by a simple operation.

In the above configuration, preferably, the ground angle maintaining controlling section executes the control such that the ground pivot angle may be confined within a non-sensitive range which is a predetermined range from the target ground pivot angle. With this configuration, it becomes possible to reduce the control frequency, thereby smoothing the bucket movement.

In the above, the instruction operational tool comprises an operational lever. Preferably, the operational lever comprises a cross-pivoting operational lever. The operational lever can comprise a neutral-return type operational lever. Further, the instruction operational tool comprises a lever operation detector for detecting an operated position of the operational lever. Preferably, the lever operation detector comprise a plurality of switches for detecting pivotal operations of the operational lever to respective operational positions of the operational lever. Alternatively, the lever operation detector can comprise a rotary potentiometer. Preferably, the lever operation detector comprises a rotary potentiometer for detecting a pivotal operation in a front/rear direction and a rotary potentiometer for detecting a pivotal operation in the right/left direction.

The present invention is applicable to a front loader to be mounted on a traveling vehicle body such as a tractor.

The invention claimed is:

1. A front loader comprising:

a boom actuator configured to pivotally drive a boom along a vertical direction relative to a traveling vehicle body about a first pivot axis which is oriented along a right/left direction;

a bucket actuator configured to pivotally drive a bucket along the vertical direction relative to the boom about a second pivot axis which is oriented along the right/left direction;

a manual controlling section for controlling operations of the boom actuator and the bucket actuator based on a manual operation of an operational tool;

a boom angle detector for detecting a vertical pivot angle of the boom;

a bucket angle detector for detecting a vertical pivot angle of the bucket relative to the boom;

a calculating section for calculating a ground pivot angle of the bucket based on an output from the boom angle detector and an output from the bucket angle detector;

a storage section storing relation data representing relation between a vertical pivot angle of the boom and a limit scoop angle of the bucket;

a setting section for setting the limit scoop angle corresponding to a vertical pivot angle of the boom, based on the output from the boom angle detector and the relation data; and a scoop angle limit controlling section configured to control an operation of the bucket actuator in such a manner that the ground pivot angle of the bucket will not exceed the set limit scoop angle when arrival of the ground pivot angle of the bucket at the set limit scoop angle is detected based on an output from the setting section and an output from the calculating section.

2. The front loader according to claim 1, wherein: the front loader further comprises a ground angle maintaining controlling section for controlling the operation of the bucket actuator such that a ground pivot angle of the bucket may be maintained constant irrespective of any vertical pivotal movement of the boom;

wherein the manual controlling section controls the operation of the bucket actuator on priority over the ground angle maintaining controlling section; and wherein the scoop angle limit controlling section controls the operation of the bucket actuator on priority over the ground angle maintaining controlling section and the manual controlling section.

3. The front loader according to claim 1, wherein the relation data is set such that the closer the vertical pivot angle of the boom to the set angle, the greater the limit scoop angle of the bucket, in case the vertical pivot angle of the boom is smaller than the set angle, whereas the limit scoop angle of the bucket is maintained at a constant angle allowing prevention of dropping of scooped object from the bucket to the boom side in case the vertical pivot angle of the boom exceeds the set angle.

* * * * *